US007934521B1

(12) United States Patent
Busse et al.

(10) Patent No.: US 7,934,521 B1
(45) Date of Patent: May 3, 2011

(54) CONFIGURABLE FLUID TRANSFER MANIFOLD FOR INFLATABLE FOOTWEAR

(75) Inventors: Mark Busse, Providence, RI (US); Brian Christensen, Centerville, MA (US); Paul M. Davis, Blackstone, MA (US); William Marvin, Brighton, MA (US); Erica Thomas, Brighton, MA (US)

(73) Assignee: Reebok International, Ltd., Canton, MA (US)

( * ) Notice: Subject to any disclaimer, the term of this patent is extended or adjusted under 35 U.S.C. 154(b) by 1168 days.

(21) Appl. No.: 11/613,982

(22) Filed: Dec. 20, 2006

(51) Int. Cl.
*F17D 1/00* (2006.01)
*A43B 13/20* (2006.01)

(52) U.S. Cl. ..... 137/884; 36/29

(58) Field of Classification Search ..... 137/884; 36/29, 3 B, 153, 154, 35 B
See application file for complete search history.

(56) References Cited

U.S. PATENT DOCUMENTS

| | | | |
|---|---|---|---|
| 508,034 | A | 11/1893 | Moore |
| 547,645 | A | 9/1895 | MacDonald |
| 566,422 | A | 8/1896 | Singleton |
| 580,501 | A | 4/1897 | Mobberley |
| 586,155 | A | 7/1897 | Bascom |
| 850,327 | A | 4/1907 | Tauber |
| 1,069,001 | A | 7/1913 | Guy |
| 1,148,376 | A | 7/1915 | Gay |
| 1,193,608 | A | 8/1916 | Poulson |
| 1,198,476 | A | 9/1916 | Pearson |
| 1,304,915 | A | 5/1919 | Spinney |
| 1,328,154 | A | 5/1920 | Jackerson |
| 1,498,838 | A | 6/1924 | Harrison, Jr. |
| 1,605,985 | A | 11/1926 | Rasmussen |
| 1,954,122 | A | 4/1934 | Fiori |
| 1,979,972 | A | 11/1934 | Guild |
| 2,007,803 | A | 7/1935 | Kelly |
| 2,020,240 | A | 11/1935 | Cochran |
| 2,036,695 | A | 4/1936 | Heigis |
| 2,080,469 | A | 5/1937 | Gilbert |
| 2,080,499 | A | 5/1937 | Nathansohn |
| 2,177,116 | A | 10/1939 | Persichino |
| 2,488,382 | A | 11/1949 | Davis |
| 2,532,742 | A | 12/1950 | Stoiner |

(Continued)

FOREIGN PATENT DOCUMENTS

| | | |
|---|---|---|
| BR | 8305004 | 9/1983 |

(Continued)

*Primary Examiner* — Ted Kavanaugh
(74) *Attorney, Agent, or Firm* — Sterne, Kessler, Goldstein & Fox P.L.L.C.

(57) ABSTRACT

A configurable fluid transfer system for inflatable footwear includes a manifold. The manifold has a top surface, a bottom surface with a plurality of openings, a lateral side with at least one opening, a medial side, a heel side with a plurality of openings and a forefoot side. The manifold is part of an inflation system having an underfoot pump connected to one of the plurality of openings in the heel side of the manifold, an inflatable forefoot bladder connected to two of the plurality of openings in the bottom surface of the manifold and an inflatable heel bladder connected to one of the plurality of openings in the bottom surface of the manifold. fluid flows from the underfoot pump to the inflatable forefoot bladder through a one-way valve and into a first channel in the manifold connected to a forefoot bladder. The fluid inflates the forefoot bladder and exits into a second channel in the manifold. fluid flows from the inflatable forefoot bladder to the inflatable heel bladder through the second channel and inflates the heel bladder.

44 Claims, 14 Drawing Sheets

U.S. PATENT DOCUMENTS 2,600,239 A 6/1952 Gilbert
2,605,560 A 8/1952 Gouabault
2,638,690 A 5/1953 Bullard, III
2,677,904 A 5/1954 Reed
2,682,712 A 8/1954 Cooksley
2,717,100 A 9/1955 Engelder
2,774,152 A 12/1956 Alber
2,863,230 A 12/1958 Cortina
2,981,010 A 4/1961 Aaskov
3,015,414 A 1/1962 Wilson
3,027,659 A 4/1962 Gianola
3,044,190 A 7/1962 Urbany
3,068,494 A 12/1962 Pinkwater
3,120,712 A 2/1964 Menken
3,221,932 A 12/1965 Anderson
3,225,463 A 12/1965 Burnham
3,331,146 A 7/1967 Karras
3,372,495 A 3/1968 Finn
3,410,004 A 11/1968 Finn
3,664,043 A 5/1972 Polumbus, Jr.
3,685,176 A 8/1972 Rudy
3,716,930 A 2/1973 Brahm
3,744,159 A 7/1973 Nishimura
3,760,056 A 9/1973 Rudy
3,788,344 A * 1/1974 Dyck ..... 137/271
3,854,228 A 12/1974 Conroy
3,973,336 A 8/1976 Ahn
3,995,653 A 12/1976 Mackal et al.
4,014,048 A 3/1977 Rappleyea
4,106,222 A 8/1978 Houck
4,129,951 A 12/1978 Petrosky
4,169,353 A 10/1979 Fresard
4,188,976 A * 2/1980 Austin, Jr. ..... 137/637.1
4,217,705 A 8/1980 Donzis
4,219,945 A 9/1980 Rudy
4,232,459 A 11/1980 Vaccari
4,271,606 A 6/1981 Rudy
4,361,969 A 12/1982 Vermonet
4,397,104 A 8/1983 Doak
4,417,407 A 11/1983 Fukuoka
4,446,634 A * 5/1984 Johnson et al. ..... 36/29
4,458,430 A 7/1984 Peterson
4,462,171 A 7/1984 Whispell
4,571,853 A 2/1986 Medrano
4,610,099 A 9/1986 Signori
4,628,945 A 12/1986 Johnson, Jr.
4,662,087 A 5/1987 Beuch
4,662,412 A 5/1987 Swallert
4,670,995 A 6/1987 Huang
4,700,403 A 10/1987 Vacanti
4,702,022 A 10/1987 Porcher
4,730,403 A 3/1988 Walkhoff
4,744,157 A 5/1988 Dubner
4,760,651 A 8/1988 Pon-Tzu
4,763,426 A 8/1988 Polus et al.
4,776,110 A 10/1988 Shlang
4,805,601 A 2/1989 Eischen, Sr.
4,823,482 A 4/1989 Lakic
4,856,208 A 8/1989 Zaccaro
4,887,367 A 12/1989 Mackness et al.
4,906,502 A 3/1990 Rudy
4,910,889 A 3/1990 Bonaventure et al.
4,912,861 A 4/1990 Huang
D314,172 S 1/1991 Whitley, II
4,991,317 A 2/1991 Lakic
4,995,173 A 2/1991 Spier
4,999,932 A * 3/1991 Grim ..... 36/88
5,025,575 A 6/1991 Lakic
5,074,765 A 12/1991 Pekar
5,083,581 A 1/1992 Jaw
5,113,599 A 5/1992 Cohen et al.
5,129,107 A 7/1992 Lorenzo
5,144,708 A 9/1992 Pekar
5,155,864 A 10/1992 Walker et al.
5,155,865 A 10/1992 Walker et al.
5,155,866 A 10/1992 Walker et al.
5,158,767 A 10/1992 Cohen et al.
5,178,191 A * 1/1993 Schaefer ..... 137/884
5,181,279 A 1/1993 Ross
5,195,254 A 3/1993 Tyng
5,230,249 A 7/1993 Sasaki et al.
5,253,435 A 10/1993 Auger et al.
5,257,470 A 11/1993 Auger et al.
5,343,638 A 9/1994 Legassie et al.
5,351,710 A 10/1994 Phillips
5,353,525 A 10/1994 Grim
5,392,534 A 2/1995 Grim
5,406,661 A 4/1995 Pekar
5,416,986 A * 5/1995 Cole et al. ..... 36/29
5,416,988 A 5/1995 Potter et al.
5,444,926 A 8/1995 Allen et al.
5,638,565 A 6/1997 Pekar
5,673,500 A * 10/1997 Huang ..... 36/136
5,692,321 A 12/1997 Holstine
5,765,298 A 6/1998 Potter et al.
5,771,606 A 6/1998 Litchfield et al.
5,806,208 A 9/1998 French
5,893,219 A 4/1999 Smith et al.
5,979,078 A 11/1999 McLaughlin
5,987,779 A 11/1999 Litchfield et al.
6,014,823 A * 1/2000 Lakic ..... 36/93
6,134,812 A 10/2000 Voss
6,161,240 A 12/2000 Huang
6,195,914 B1 3/2001 Otis
6,237,251 B1 5/2001 Litchfield et al.
6,287,225 B1 9/2001 Touhey et al.
6,305,102 B1 * 10/2001 Doyle ..... 36/29
6,354,020 B1 3/2002 Kimball et al.
6,430,843 B1 8/2002 Potter et al.
6,463,679 B1 * 10/2002 Buttigieg ..... 36/3 B
6,505,420 B1 1/2003 Litchfield et al.
6,553,691 B2 4/2003 Huang
6,745,499 B2 * 6/2004 Christensen et al. ..... 36/29
6,785,985 B2 9/2004 Marvin et al.
6,892,477 B2 * 5/2005 Potter et al. ..... 36/29
6,988,329 B2 1/2006 Marvin et al.
7,013,585 B2 * 3/2006 Lo ..... 36/29
7,047,670 B2 5/2006 Marvin et al.
7,051,456 B2 5/2006 Swigart et al.
7,152,625 B2 12/2006 Marvin et al.
7,210,249 B2 5/2007 Passke et al.
7,395,615 B2 * 7/2008 Lee ..... 36/29
7,478,488 B1 * 1/2009 Davis et al. ..... 36/29
7,694,438 B1 * 4/2010 Christensen et al. ..... 36/29
2003/0155022 A1 * 8/2003 Weiss et al. ..... 137/627.5
2004/0088882 A1 * 5/2004 Buttigieg ..... 36/3 B
2004/0211085 A1 10/2004 Passke et al.
2005/0028404 A1 2/2005 Marvin et al.
2005/0132617 A1 * 6/2005 Potter et al. ..... 36/132
2006/0162186 A1 7/2006 Marvin et al.
2006/0272179 A1 12/2006 Passke et al.
2007/0084082 A1 4/2007 Dojan et al.
2007/0084083 A1 4/2007 Hazenberg et al.
2009/0095358 A1 4/2009 Christensen et al.

FOREIGN PATENT DOCUMENTS

DE 3427644 1/1986
EP 229273 7/1978
EP 40189 11/1981
EP 152401 8/1985
EP 184781 6/1986
EP 389215 9/1990
EP 472110 2/1992
EP 629360 12/1994
EP 630592 12/1994
FR 2496423 6/1982
GB 520514 12/1939
GB 2114425 8/1983
GB 2165439 4/1986
GB 2240254 7/1991
GB 2271710 4/1994

| | | |
|---|---|---|
| TW | 95419 | 2/1989 |
| WO | WO 87/03789 | 7/1987 |
| WO | WO 89/10074 | 11/1989 |
| WO | WO 90/04323 | 5/1990 |
| WO | WO 91/18527 | 12/1991 |
| WO | WO 93/14659 | 8/1993 |
| WO | WO 93/21790 | 11/1993 |

* cited by examiner

CONFIGURABLE FLUID TRANSFER MANIFOLD FOR INFLATABLE FOOTWEAR

BACKGROUND OF THE INVENTION

1. Field of the Invention

The present invention is directed to a configurable fluid transfer system for inflatable footwear, an inflation system using the configurable fluid transfer system, and a fluid flow path of the inflation system.

2. Background Art

One of the problems associated with footwear, especially athletic shoes, has always been striking a balance between support and cushioning. Throughout the course of an average day, the feet and legs of an individual are subjected to substantial impact forces. Running, jumping, walking, and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot.

An athlete's stride is partly the result of energy which is stored in the flexible tissues of the foot. For example, a typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. The discomfort for the wearer that results may diminish the incentive for further athletic activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole (typically including an outsole, midsole and insole) which absorbs shocks. However, the sole should also possess enough resiliency to prevent the sole from being "mushy" or "collapsing," thereby unduly draining the stored energy of the wearer.

In light of the above, numerous attempts have been made to incorporate into a shoe improved cushioning and resiliency. For example, attempts have been made to enhance the natural resiliency and energy return of the foot by providing shoes with soles which store energy during compression and return energy during expansion. These attempts have included the formation of shoe soles that include springs, gels or foams such as ethylene vinyl acetate (EVA) or polyurethane (PU). However, all of these tend to either break down over time or do not provide adequate cushioning characteristics.

Another concept practiced in the footwear industry to improve cushioning and energy return has been the use of fluid-filled systems within shoe soles. These devices attempt to enhance cushioning and energy return by transferring a pressurized fluid between the heel and forefoot areas of a shoe. The basic concept of these devices is to have cushions containing pressurized fluid disposed adjacent the heel and forefoot areas of a shoe.

However, a cushioning device which is pressurized with fluid at the factory is comparatively expensive to manufacture. Further, pressurized fluid tends to escape from such a cushioning device, requiring large molecule fluids such as Freon gas to be used as the inflating fluid. A cushioning device which contains air at ambient pressure provides several benefits over similar devices containing pressurized fluid. For example, generally a cushioning device which contains air at ambient pressure will not leak and lose air, because there is no pressure gradient in the resting state.

Typically, an inflatable system for footwear includes a bladder, an inflation mechanism, a deflation mechanism, and one or more one-way valves to control airflow through the system. U.S. Pat. No. 6,785,985 to Marvin et al. is an example of such an inflatable system for footwear.

However, for each model of footwear, a different type of inflatable system with different components and placement of the components is often required. Separate systems must be manufactured for each model of footwear. Therefore, there exists a need in the art to have a configurable fluid transfer system which can be utilized in numerous applications.

BRIEF SUMMARY OF THE INVENTION

Disclosed herein is a configurable fluid transfer system for inflatable footwear comprising a manifold. The manifold comprises a top surface, a bottom surface with a plurality of openings, a lateral side with at least one opening, a medial side, a heel side with a plurality of openings and a forefoot side.

Also disclosed herein is an inflation system comprising a manifold comprising a top surface, a bottom surface with a plurality of openings, a lateral side with at least one opening, a medial side, a heel side with a plurality of openings and a forefoot side. An underfoot pump is connected to one of the plurality of openings in the heel side of the manifold, an inflatable forefoot bladder is connected to two of the plurality of openings in the bottom surface of the manifold and an inflatable heel bladder is connected to one of the plurality of openings in the bottom surface of the manifold.

In addition, disclosed herein is an fluid flow system for an article of inflatable footwear, the fluid flow system comprising a manifold for connecting components of the fluid flow system; an intake check valve for introducing fluid into the fluid flow system; an underfoot pump associated with the intake check valve and connected with the manifold for pushing the fluid introduced in the intake check valve into the manifold and through the fluid flow system; an inflatable forefoot bladder connected to the manifold in a first location and a second location, wherein the first location receives the fluid from the underfoot pump and inflates the inflatable forefoot bladder and the second location introduces fluid back into the manifold; an inflatable heel bladder connected to the manifold for receiving fluid from the inflatable forefoot bladder; and a pressure regulator associated with an fluid flow path between the inflatable forefoot bladder and the inflatable heel bladder for regulating pressure in the fluid flow system.

BRIEF DESCRIPTION OF THE DRAWINGS/FIGURES

DETAILED DESCRIPTION OF THE INVENTION

Figure 1:
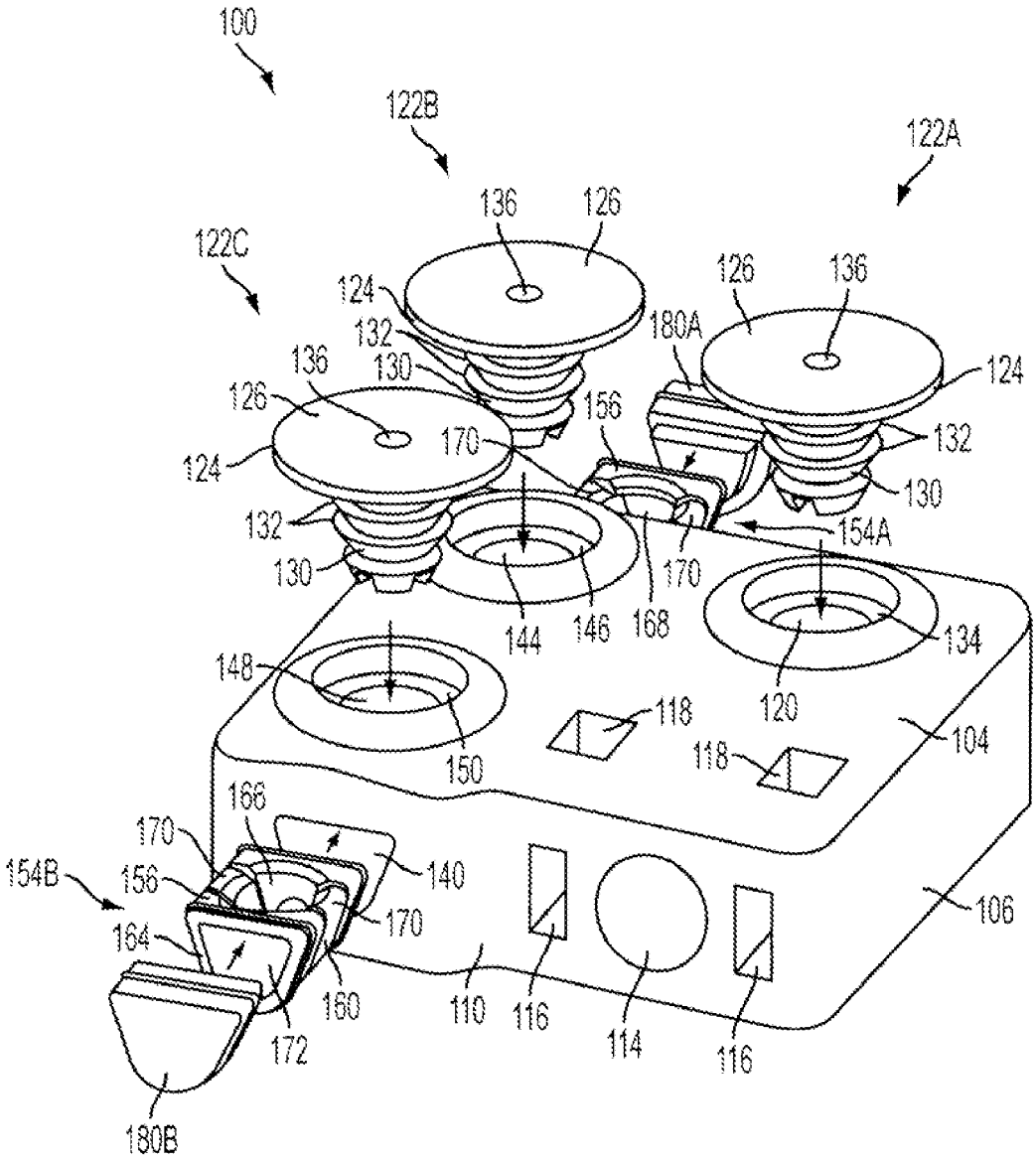
FIG. 1 is a first perspective view of a first exemplary manifold taken of the bottom surface.
Figure 2:
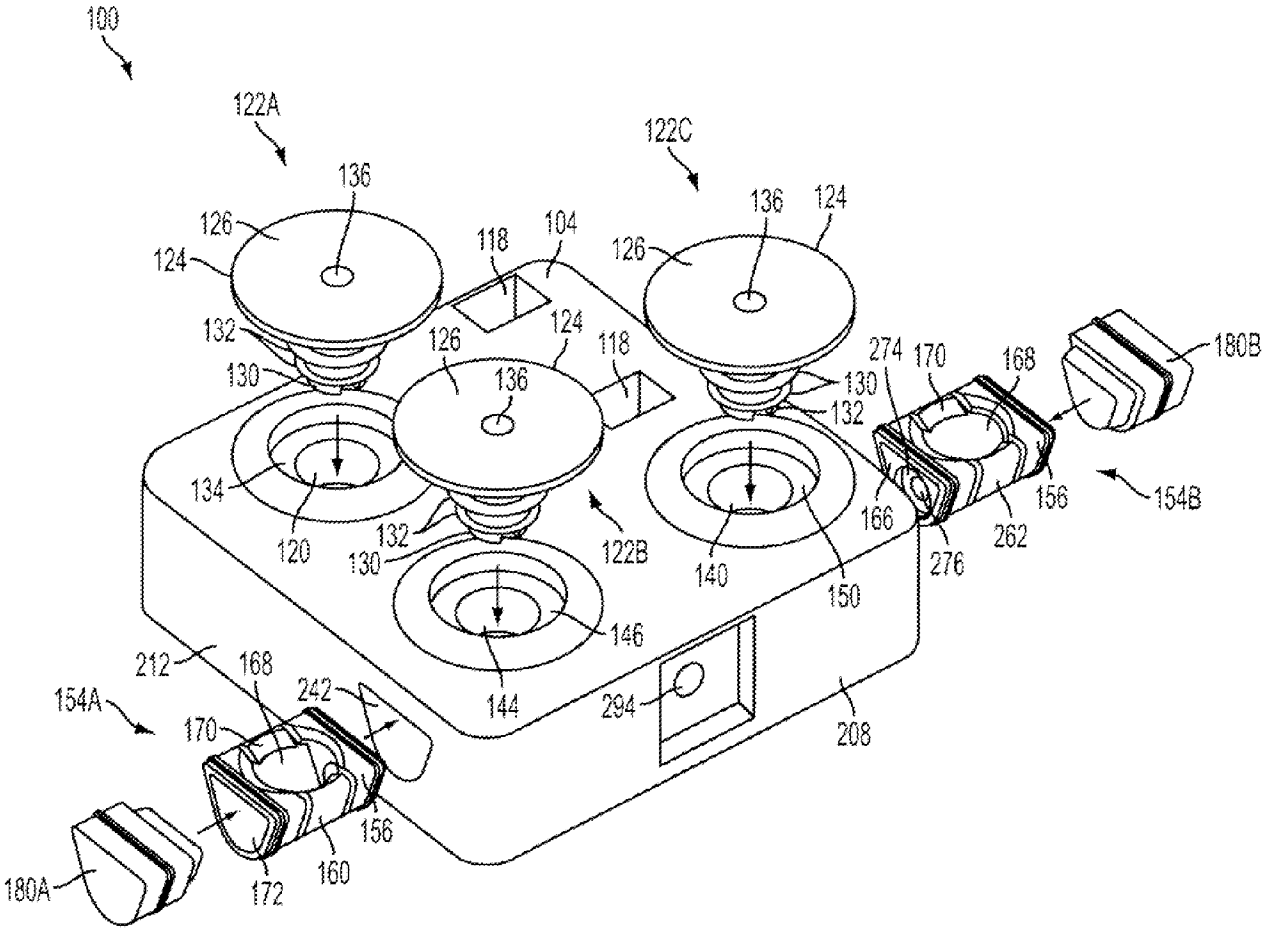
FIG. 2 is a second perspective view of a first exemplary manifold taken of the bottom surface.
Figure 3:
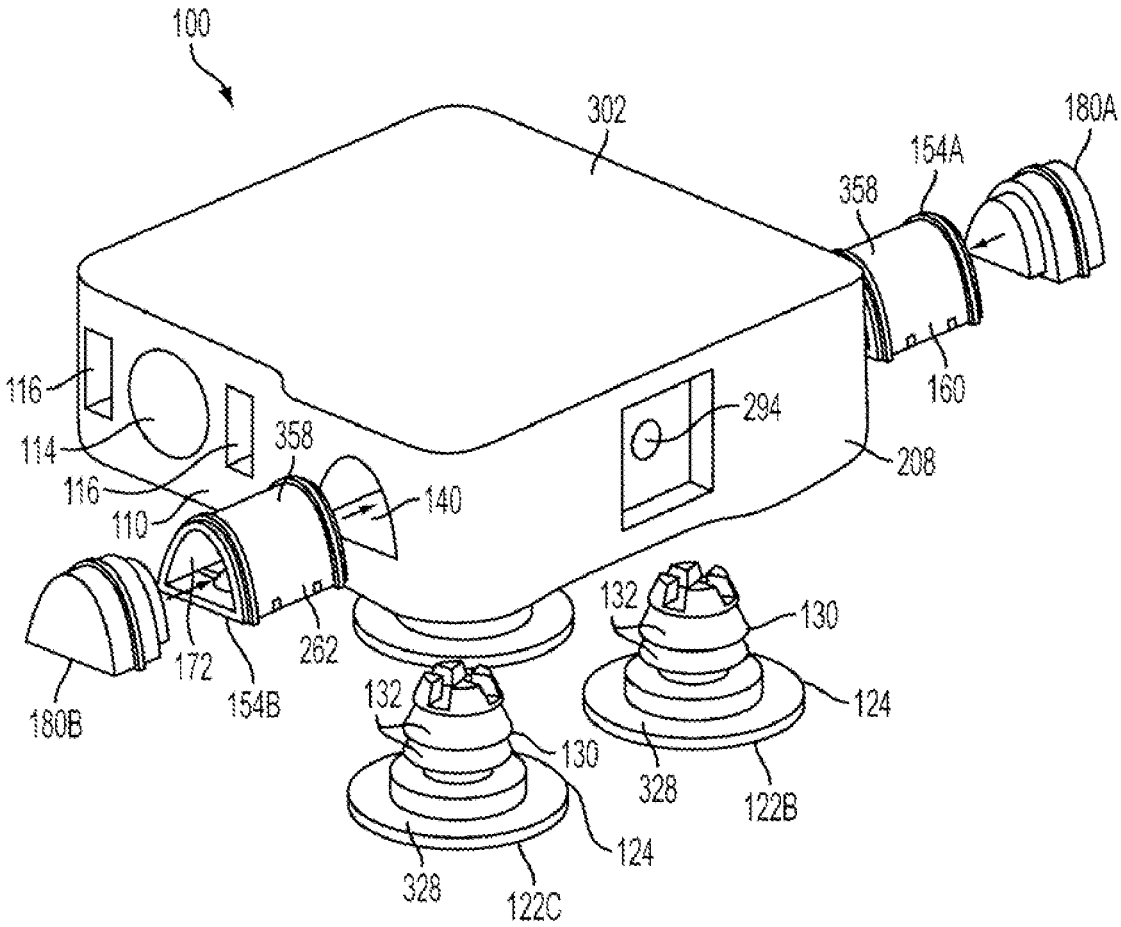
FIG. 3 is a first perspective view of a first exemplary manifold taken of the top surface.
Figure 4:
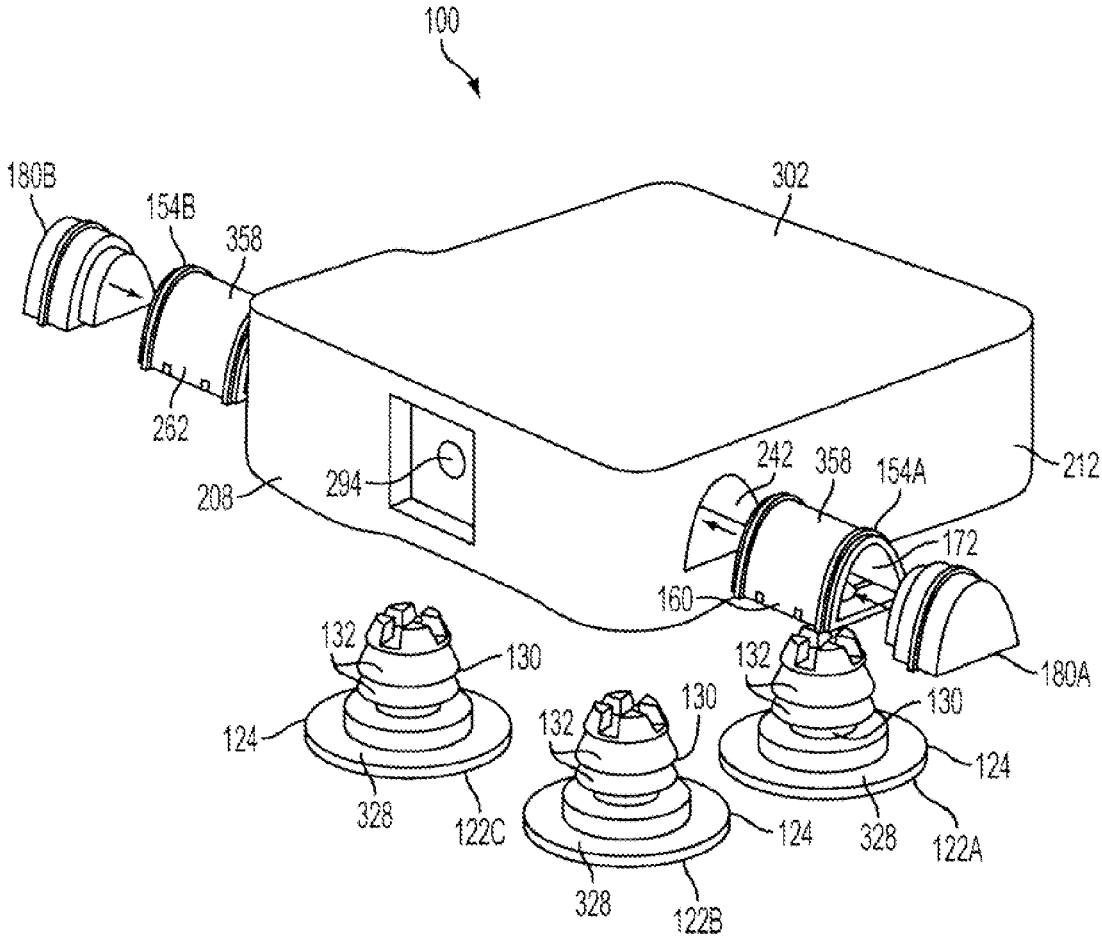
FIG. 4 is a second perspective view of a first exemplary manifold taken of the top surface.

The present invention is now described with reference to the Figures, in which like reference numerals are used to indicate identical or functionally similar elements. Also in the Figures, the left most digit of each reference numeral corresponds to the Figure in which the reference numeral first appears. While specific configurations and arrangements can be used without departing from the spirit and scope of the invention, it will be apparent to a person skilled in the relevant art that this invention can also be employed in other applications.

An exemplary fluid transfer system for utilization in an inflatable system of an article of footwear will be described with reference to FIGS. 1-5. The fluid may be, for example, air. A manifold 100 has a top surface 302, a bottom surface 104, a medial side surface 106, a lateral side surface 208, a heel side surface 110 and a forefoot side surface 212. Manifold 100 is positioned within a sole of an article of footwear such that top surface 302 faces a top of the article of footwear, bottom surface 104 faces a bottom of the article of footwear, medial side surface 106 faces a medial (inside) side of the article of footwear, lateral side surface 208 faces a lateral (outside) side of the article of footwear, heel side surface 110 faces a heel of the article of footwear and forefoot side surface 212 faces a forefoot of the article of footwear. Manifold 100 may have a peripheral flange extending from top surface 302 to assist in positioning manifold 100 in an opening in a sole of a shoe.

Figure 5:
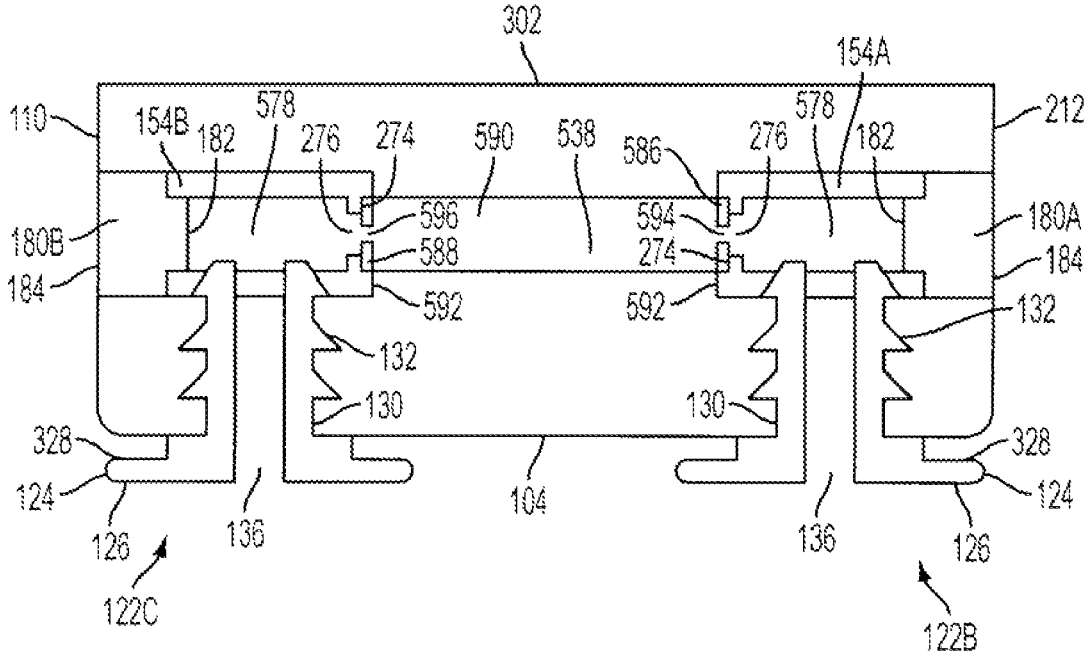
FIG. 5 is a cross section of a second fluid flow channel of a first exemplary manifold.
Figure 6:
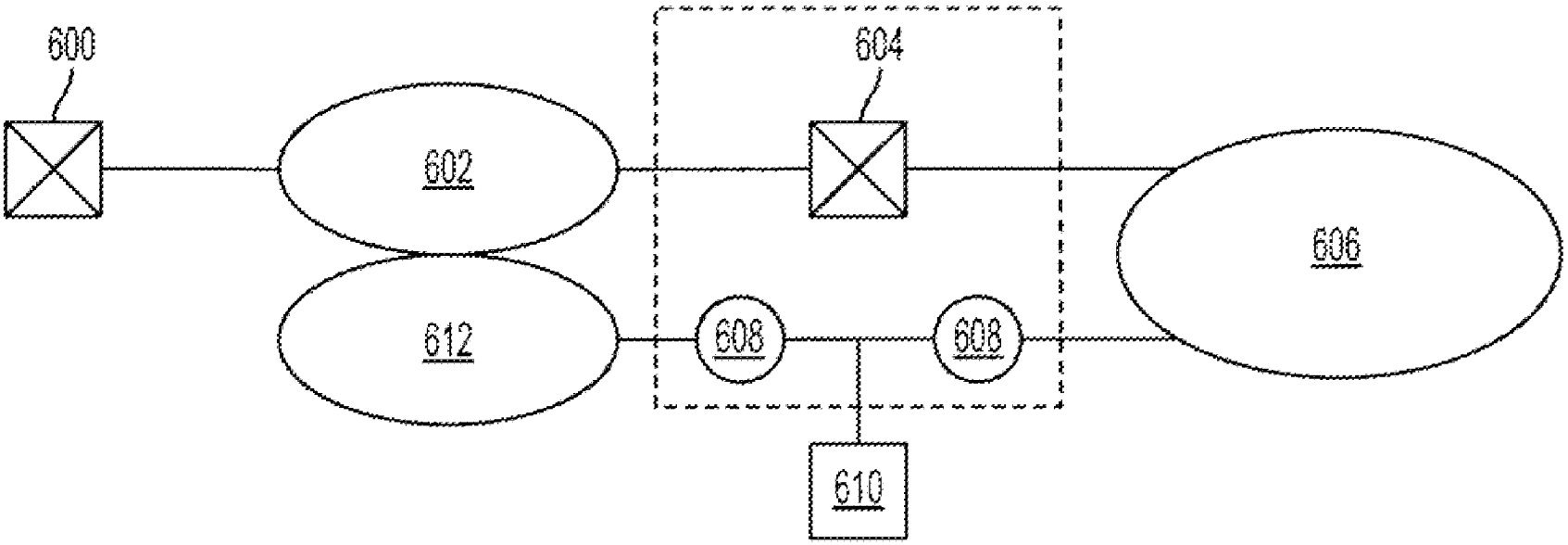
FIG. 6 is an illustration of an exemplary fluid flow path.
Figure 7:
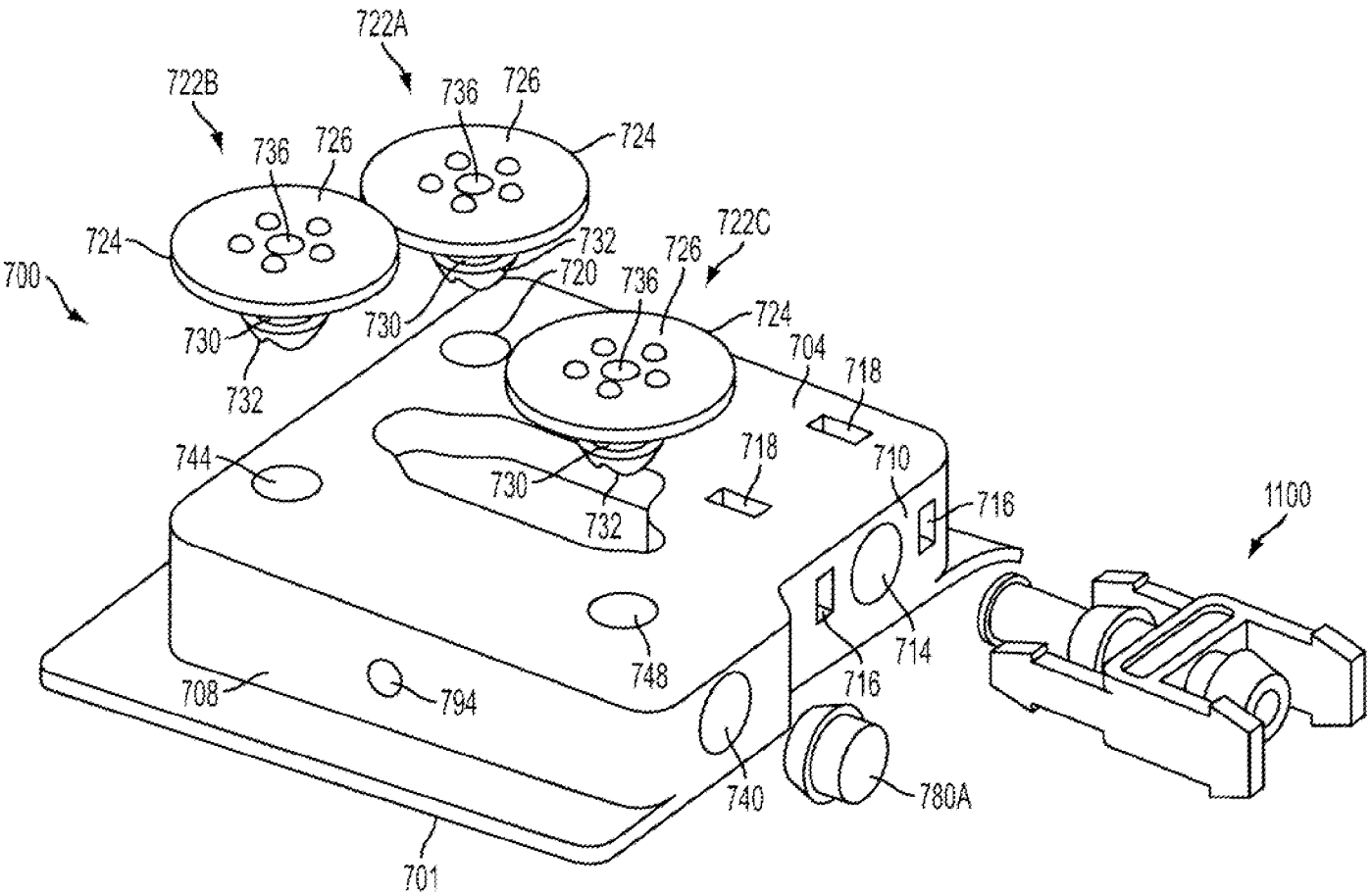
FIG. 7 is a perspective view of a second exemplary manifold taken of the bottom surface.
Figure 8:
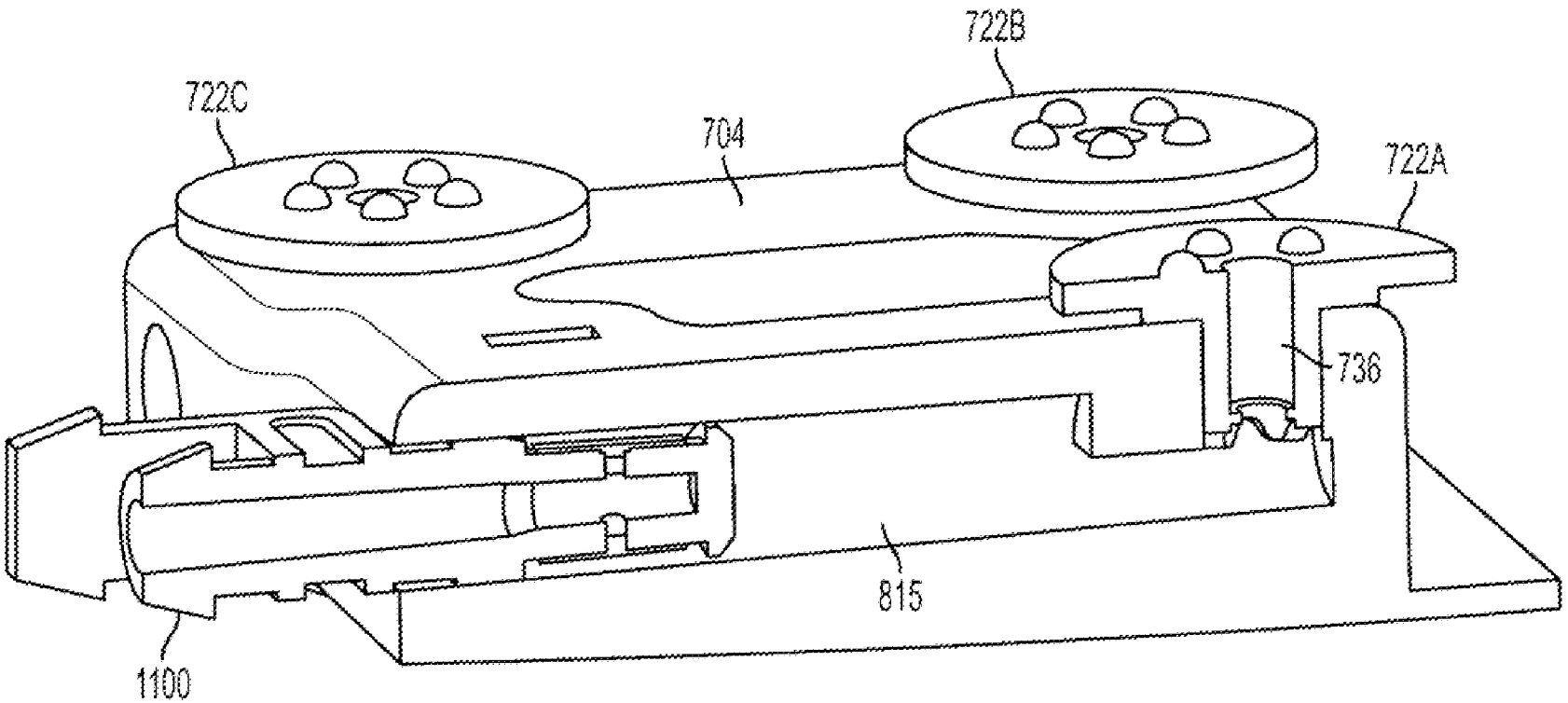
FIG. 8 is a cross section of a first fluid flow channel of a second exemplary manifold.

Manifold 100 has a plurality of openings in the various surfaces for connecting various parts of an inflation system thereto such as an underfoot pump, a one-way valve, a forefoot bladder, a heel bladder, and an adjustable fluid pressure regulator. An exemplary fluid flow path for the inflation system, as shown in FIG. 6, is for fluid to enter an underfoot pump 602 via an fluid intake valve 600 and exit underfoot pump 602 through a one-way valve 604 into the manifold to the forefoot bladder 606. The fluid then inflates the forefoot bladder 606 and exits the forefoot bladder 606 back into the manifold, shown with phantom lines, and into the heel bladder 612 for inflating the heel bladder 612. The presence of the forefoot bladder 606 minimizes the amount of back flow fluid pressure experienced by the one-way valve 604 because fluid travels onward to the heel bladder 612 rather than trying to reenter the one-way valve 604. Sudden impact forces may create excessive pressure on one-way valve 604 and forefoot bladder 606 acts as an intermediate chamber disposed between underfoot pump 602 and inflatable heel bladder 612 to act as a holding cell to reduce sudden pressures on one-way valve 604. The intermediate chamber is a forefoot reservoir which acts as a forefoot cushioning component and secondary pump to drive fluid into heel bladder/cushioning component. A pressure regulator 610 is located between two fluid flow restrictors 608 in the fluid flow pathway between forefoot bladder 606 and heel bladder 612. Fluid flow restrictors 608 prevent the inflatable heel bladder 612 and the inflatable forefoot bladder 606 from independently deflating too quickly during activity. Adjustable pressure regulator 610 bleeds off any additional fluid when a desired pressure is present and will not allow the bladder(s) to be inflated beyond the desired pressure no matter how much a user attempts to inflate the shoe. FIGS. 1-5 illustrate an exemplary manifold 100 that can be utilized with this exemplary fluid flow path.

Heel side surface 110 of manifold 100 has an opening 114 for inserting a one-way valve connected to an underfoot pump. Opening 114 is preferably for inserting a portion of a one-way valve with an opening allowing fluid from the one-way valve coming from the underfoot pump to enter into manifold 100. Heel side surface 110 has openings 116 and bottom surface 104 has openings 118 for locking arms or prongs of the one-way valve. Opening 114 leads to a first channel (not shown) within manifold 100 that extends forward toward forefoot side surface 212 parallel to medial side surface 106. The first channel allows fluid exiting the underfoot pump via the one-way valve to travel through the fluid flow pathway of the first channel to opening 120 in bottom surface 104, which is perpendicular to and intersects the first channel. A connector 122A attached to an inflatable forefoot bladder is inserted into opening 120.

Connector 122A has a flange 124 with a top surface 126 and a bottom surface 328. A body 130 extends from bottom surface 328 of flange 124 and has at least one barb 132. Body 130 is inserted into opening 120 and barbs 132 hold connector 122A in place inside manifold 100. There is a recess 134 surrounding opening 120 such that a step on flange 124 sits in recess 134 and top surface 126 of connector 122A is substantially parallel with bottom surface 104 of manifold 100. A hole 136 extends through flange 124 and body 130 to provide a passageway for fluid flowing from the first channel of manifold 100 and into the inflatable forefoot bladder attached to flange 124 of connector 122A.

A second channel 538 parallel to lateral side surface 208 extends from an opening 140 located in heel side surface 110 to an opening 242 located in forefoot side surface 212 allows fluid exiting the inflatable forefoot bladder to travel into the inflatable heel bladder. Bottom surface 104 has an opening 144 which is perpendicular to and intersects channel 538 near forefoot side surface 212. A connector 122B attached to the inflatable forefoot is inserted into opening 144.

Connector 122B is similar to connector 122A, however in some embodiments they may have different sized holes 136 and has a flange 124 with a top surface 126 and a bottom surface 328. A body 130 extends from bottom surface 328 of flange 124 and has at least one barb 132. Body 130 is inserted into opening 144 and barbs 132 hold connector 122B in place inside manifold 100. There is a recess 146 surrounding opening 144 such that a step on flange 124 sits in recess 146 and top surface 126 of connector 122B is substantially parallel with bottom surface 104 of manifold 100. A hole 136 extends through flange 124 and body 130 allowing for the passage of fluid through the connector from the inflatable forefoot bladder into second channel 538.

Bottom surface 104 also has an opening 148 which is perpendicular to and intersects channel 538 near heel side surface 110. A connector 122C attached to an inflatable heel bladder is inserted into opening 148. Connector 122C is similar to connectors 122A and 122B, however in some embodiments it may have different sized holes 136 and has a flange 124 with a top surface 126 and a bottom surface 328. A body 130 extends from bottom surface 328 of flange 124 and has at least one barb 132. Body 130 is inserted into opening 148 and barbs 132 hold connector 122C in place inside manifold 100. There is a recess 150 surrounding opening 148 such that a step of flange 124 sits in recess 150 and top surface 126 of connector 122C is substantially parallel with bottom surface 104 of manifold 100. A hole 136 extends through flange 124 and body 130 allowing for the passage of fluid flowing through second channel 538 from the inflatable forefoot bladder to pass through the connector into the inflatable heel bladder.

Forefoot side surface 212 has an opening 242 leading to second channel 538. An fluid flow restrictor housing 154A is inserted into opening 242. Fluid flow restrictor housing 154A has a flat top surface 156, a rounded bottom surface 358, a slanted right side 160, a slanted left side 262, a front side 164 and a rear side 166. Flat top surface 156 has an opening 168 with locking mechanisms 170 on either side of opening 168 and form part of slanted right side 160 and slanted left side 262. Front side 164 has an opening 172. Rear side 166 has a recessed surface 274 with a hole 276. Fluid flow restrictor housing 154A has a hollow interior chamber 578 connected to openings 168 and 172 and hole 276. Rear side 166 of fluid flow restrictor housing is inserted into opening 242 such that opening 168 in flat top surface 156 is aligned with opening 144 in bottom surface 104 of manifold 100. When connector 122B is inserted into opening 144, a portion of body 130 is inserted into opening 168 of fluid flow restrictor housing 154A and one of barbs 132 of connector 122B is retained by locking mechanisms 170. A plug 180A having a first side 182 shaped to correspond to opening 172 and a second side 184 shaped to correspond to opening 242 is inserted into opening 242, as shown in FIG. 5. When inserted, first side 182 is inserted into opening 172 in front side 164 of fluid flow restrictor housing 154A and second side 184 is flush with forefoot side surface 212.

Similarly, heel side surface 110 has an opening 140 leading to second channel 538. A fluid flow restrictor housing 154B, similar to fluid flow restrictor housing 154A, is inserted into opening 140. Fluid flow restrictor housing 154B has a flat top surface 156, a rounded bottom surface 358, a slanted right side 160, a slanted left side 262, a front side 164 and a rear side 166. Flat top surface 156 has an opening 168 with locking mechanisms 170 on either side of opening 168 and form part of slanted right side 160 and slanted left side 262. Front side 164 has an opening 172. Rear side 166 has a recessed surface 274 with a hole 276. Fluid flow restrictor housing 154B has a hollow interior chamber 578 connected to openings 168 and 172 and hole 276. Rear side 166 of fluid flow restrictor housing is inserted into opening 140 such that opening 168 in flat top surface 156 is aligned with opening 148 in bottom surface 104 of manifold 100. When connector 122C is inserted into opening 148, a portion of body 130 is inserted into opening 168 of fluid flow restrictor housing 154B and one of barbs 132 of connector 122C is retained by locking mechanisms 170. A plug 180B having a first side 182 shaped to correspond to opening 172 and a second side 184 shaped to correspond to opening 140 is inserted into opening 140, as shown in FIG. 5. When inserted, first side 182 is inserted into opening 172 in front side 164 of fluid flow restrictor housing 154B and second side 184 is flush with heel side surface 110.

As shown in FIG. 5, second channel 538 has an intermediary chamber 590 in between a first chamber, in which fluid flow restrictor 154A and plug 180A are inserted, and a second chamber, in which fluid flow restrictor 154B and plug 180B are inserted. The height of first and second chambers is approximately the same and is larger than the height of intermediary chamber 590. Intermediary chamber 590 is positioned such that it has a same center as first and second chambers and is aligned with a center of holes 276 of fluid flow restrictor housings 154A, 154B. A wall 592 juts into the periphery of the intersection of the first chamber and intermediary chamber 590 and into the periphery of the intersection of the second chamber and intermediary chamber 590. Rear sides 166 of fluid flow restrictor housings 154A, 154B abut wall 592. The height of intermediary chamber 590 is larger than the height of holes 276 of fluid flow restrictor housings 154A, 154B. An orifice disk 586 having a central opening 594 may be inserted into recessed surface 274 of fluid flow restrictor 154A. Central opening 594 of orifice disk 586 is smaller than opening 276 of fluid flow restrictor 154A. Similarly, an orifice disk 588 having a central opening 596 may be inserted into recessed surface 274 of fluid flow restrictor 154B. Central opening 596 of orifice disk 588 is smaller than opening 276 of fluid flow restrictor 154B.

The above mentioned differences in height provide a turbulent fluid flow through second channel 538. When fluid exits the inflatable forefoot bladder through connector 122B it enters into chamber 578 of fluid flow restrictor housing 154A and then leaves chamber 578 through hole 276 and into intermediary chamber 590. The fluid flows through intermediary chamber 590 into hole 276 of fluid flow restrictor housing 154B and into chamber 578 of fluid flow restrictor housing 154B. The fluid then enters connector 122C and flows into the inflatable heel bladder. The cross section size of hole 276 of fluid flow restrictor housing 154B is smaller than the cross section size of intermediary chamber 590 such that flow is restricted from flowing into chamber 578 of fluid flow restrictor housing 154B and onto the inflatable heel bladder from intermediary chamber 590, thereby preventing the inflatable heel bladder from being inflated or deflated too quickly. The cross section size of hole 276 of fluid flow restrictor housing 154A is smaller than the cross section size of intermediary chamber 590 such that backflow pressure of fluid flowing back into chamber 578 of fluid flow restrictor housing 154A and onto the inflatable forefoot bladder from intermediary chamber 590 is restricted. Orifice disks 586 and 588 are customizable in that orifice disk having central openings 594 and 596 of differing diameters may be inserted to further affect fluid flow through second channel 538.

Manifold 100, connectors 122A, 122B, and 122C, fluid flow restrictor housings 154A and 154B and plugs 180A and 180B are formed through conventional methods including, but not limited to, injection molding. The material of connectors 122A, 122B, and 122C may include, without limitation, thermoplastic polyurethane of 74D Shore hardness or 90A Shore hardness. Manifold 100, fluid flow restrictor housings 154A and 154B and plugs 180A and 180B may be a polymeric material including, but not limited to, thermoplastic polyurethane.

Another exemplary fluid transfer system for utilization in fluid transfer in an inflatable system of an article of footwear that also can be utilized with the exemplary fluid flow path shown in FIG. 6 will be described with reference to FIGS. 7-10. A manifold 700 has a top surface (not shown), a bottom surface 704, a medial side surface (not shown), a lateral side surface 708, a heel side surface 710 and a forefoot side surface (not shown). Manifold 700 is positioned within a sole of an article of footwear such that the top surface faces a top of the article of footwear, bottom surface 704 faces a bottom of the article of footwear, the medial side surface faces a medial (inside) side of the article of footwear, lateral side surface 708 faces a lateral (outside) side of the article of footwear, heel side surface 710 faces a heel of the article of footwear and the forefoot side surface faces a forefoot of the article of footwear. Manifold 700 may have a peripheral flange 701 extending from the top surface on at least the medial side, the forefoot side and the lateral side to assist in positioning manifold 700 in an opening in a sole of a shoe.

Manifold 700 has a plurality of openings in the various surfaces for connecting various parts of an inflation system thereto such as an underfoot pump, a one-way valve 1100, a forefoot bladder and a heel bladder.

Heel side surface 710 of manifold 700 has an opening 714 for inserting one-way valve 1100 connected to an underfoot pump. Opening 714 is preferably for inserting a portion of a one-way valve 1100 with an opening allowing fluid from the one-way valve coming from the underfoot pump to enter into manifold 700. Heel side surface 710 has openings 716 and bottom surface 704 has openings 718 for locking arms or prongs of the one-way valve 1100. Opening 714 leads to a first channel 815 within manifold 700 that extends forward toward the forefoot side surface parallel to the medial side surface. First channel 815 allows fluid exiting the underfoot pump via the one-way valve 1100 to travel through the fluid flow pathway of first channel 815 to opening 720 in bottom surface 704, which is perpendicular to and intersects first channel 815. A connector 722A attached to an inflatable forefoot bladder is inserted into opening 720.

Connector 722A has a flange 724 with a top surface 726 and a bottom surface (not shown). A body 730 extends from the bottom surface of flange 724 and has at least one barb 732. Body 730 is inserted into opening 720 and barb 732 holds connector 722A in place inside manifold 700. Adhesive may be applied to cement or bond connector 722A in place in opening 720. A hole 736 extends through flange 724 and body 730 to provide a passageway for fluid flowing from first channel 815 into the inflatable forefoot bladder attached to flange 724 of connector 722A.

A second channel 938 parallel to lateral side surface 708 extends from an opening 740 located in heel side surface 710 to the forefoot side surface and allows fluid exiting the inflatable forefoot bladder to travel into the inflatable heel bladder. Bottom surface 704 has an opening 744 which is perpendicular to and intersects second channel 938 near the forefoot side surface. A connector 722B attached to the inflatable forefoot is inserted into opening 744.

Connector 722B is similar to connector 722A, except as discussed below, and has a flange 724 with a top surface 726 and a bottom surface (not shown). A body 730 extends from the bottom surface of flange 724 and has at least one barb 732. Body 730 is inserted into opening 744 and barb 732 holds connector 722B in place inside manifold 700. Adhesive may be applied to cement or bond connector 722B in place in opening 744. A hole 736 extends through flange 724 and body 730 allowing for the passage of fluid through connector 722B from the inflatable forefoot bladder into second channel 938.

Bottom surface 704 also has an opening 748 which is perpendicular to and intersects second channel 938 near heel side surface 710. A connector 722C attached to an inflatable heel bladder is inserted into opening 748. Connector 722C is similar to connectors 722B, and has a flange 724 with a top surface 726 and a bottom surface (not shown). A body 730 extends from the bottom surface of flange 724 and has at least one barb 732. Body 730 is inserted into opening 748 and barb 732 holds connector 722C in place inside manifold 100. Adhesive may be applied to cement or bond connector 722C in place in opening 748. A hole 736 extends through flange 724 and body 730 allowing for the passage of fluid flowing through second channel 938 from the inflatable forefoot bladder to pass through connector 722C into the inflatable heel bladder.

Heel side surface 710 has an opening 740 leading to second channel 938. A plug 780A shaped to correspond to opening 740 is inserted into opening 740.

Figure 9:
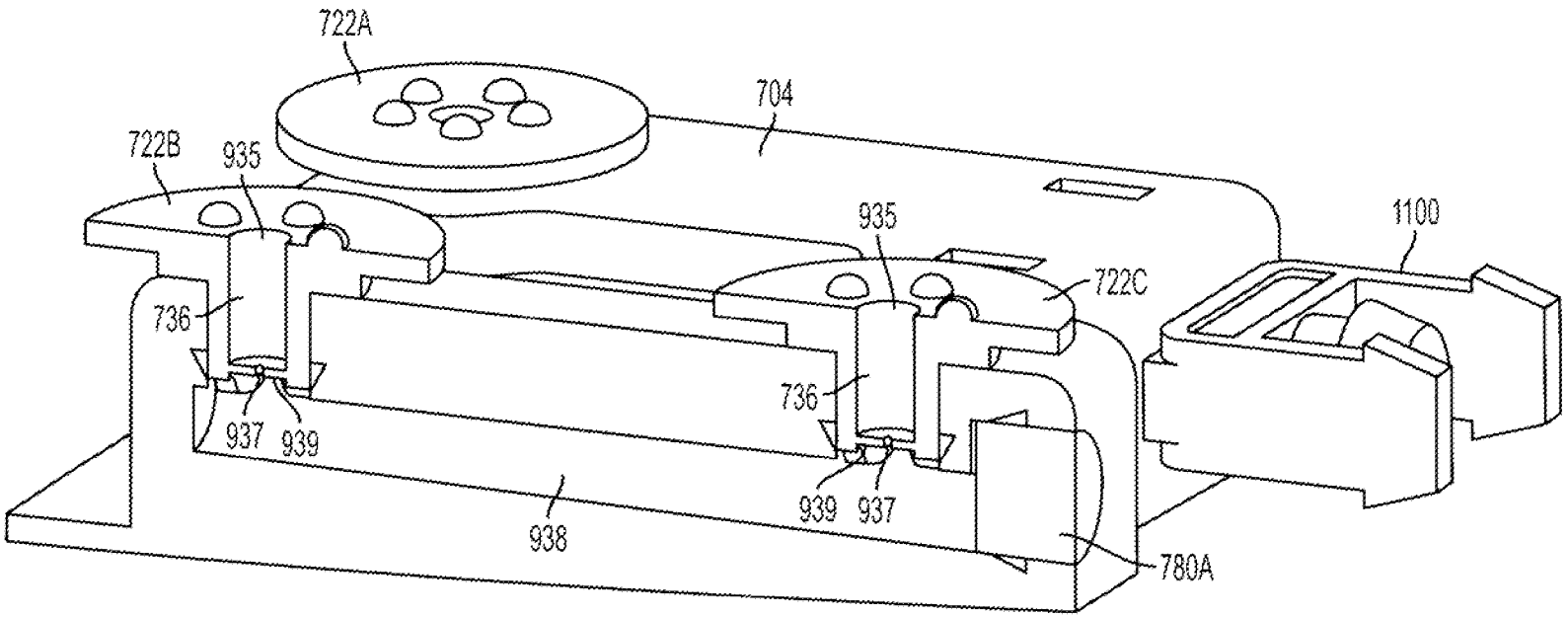
FIG. 9 is a cross section of a second fluid flow channel of a second exemplary manifold.
Figure 10:
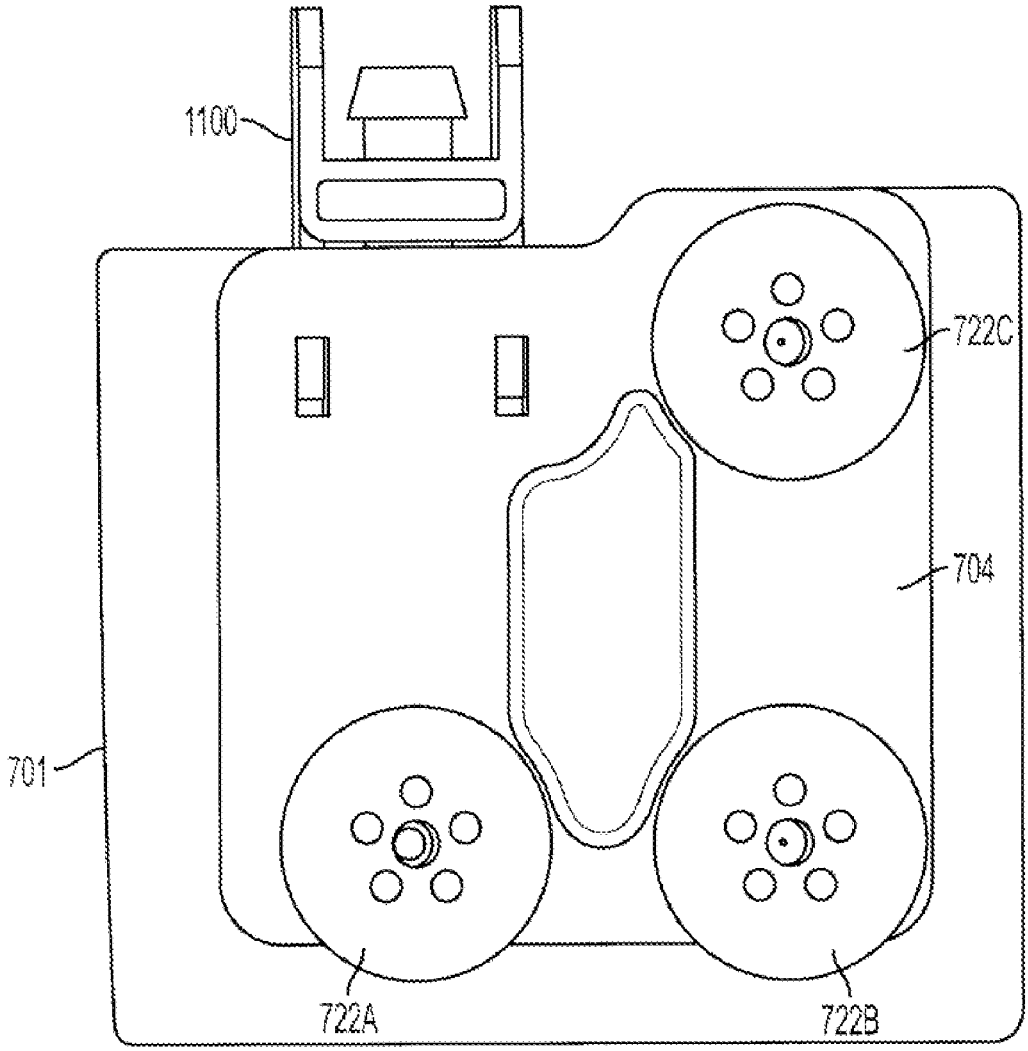
FIG. 10 is a plan view of a second exemplary manifold taken of the bottom surface.

As shown in FIGS. 9 and 10, hole 736 of connectors 722B, 722C each extend through the flange and the barbed body and have a first end 935 at top surface 726 of flange 724 with a first diameter and a second end 937 at an end 939 of barbed body 730 with a second diameter. The first diameter may be larger than the second diameter. Having second ends 937 of holes 736 have a second diameter smaller than the first diameter causes the smaller second diameter second ends 937 to act as fluid flow restrictors. This results in a restriction of fluid flow into and out of second channel 938.

Air flow restriction is important because it prevents the inflatable heel and forefoot bladders from independently deflating too quickly during activity Alternatively, hole 736 of connectors 722B, 722C are substantially uniform in diameter along their length and alternative fluid flow restrictors can be utilized including, but not limited to attaching a nonwoven material over second end 937 of holes 736 or a top surface of flanges 724, or attaching a film with a hole having a smaller diameter than hole 736 over second end 937 of holes 736 or a top surface of flanges 724, or inserting an orifice disk having an opening smaller in diameter than hole 736 into hole 736.

Manifold 700, connectors 722A, 722B, and 722C, and plug 780A are formed through conventional methods including, but not limited to, injection molding. The material of connectors 722A, 722B, and 722C may include, without limitation, thermoplastic polyurethane of 74D Shore hardness or 90A Shore hardness. Connectors 722B and 722C may be initially formed such that holes 736 do not extend through all the way to ends 939 of bodies 730. Second ends 937 of holes 736 may then be formed through laser boring second ends 739 of holes 736 to have a diameter of approximately 0.010 inches. Manifold 700 may be a polymeric material including, but not limited to, thermoplastic polyurethane. Plug 780A may be a polymeric material including, but not limited to, thermoplastic polycarbonate.

One skilled in the relevant art would readily appreciate that the type of inflatable bladder for use in the inflatable system is not limited. One example of an inflatable bladder includes two films of monolayer or multilayer sealable thermoplastic material through which fluid may not readily pass. Furthermore, the two sealable thermoplastic films may be a multilayer laminate of film and fabric or of film and a non-woven material. The two films utilized to form the inflatable bladder may be the same material or different materials such as a monolayer film and a multilayer laminate. The films of different materials may be cast or coextruded to form the inflatable bladder. An exemplary film includes an outer layer of 12 mil polyester urethane of 50D Shore hardness, a scrim layer, and an inner layer of 8 mil polyester urethane of 95A Shore hardness. The material for the scrim layer is present to increase puncture resistance and to increase tensile strength and may include, but is not limited to, 210 denier nylon of high tenacity or polyester. The outer layer material should be of suitable thickness and hardness to increase puncture resistance of the bladder. The inner layers face each other in an assembled inflatable bladder.

The films are sealed around a periphery to form the inflatable bladder. In one embodiment the majority of the peripheral seal is on an inside of the inflatable bladder. Such an inflatable bladder can be made wherein the two films are positioned on top of each other and welded or otherwise sealed along a plurality of the peripheral edges leaving at least one peripheral edge unsealed. The two films are then turned inside out such that the seal is in the interior of the inflatable bladder. Then the remaining peripheral edge(s) is welded or otherwise sealed together to form the inflatable bladder. Alternatively, the peripheral seal is on an outside of the inflatable bladder wherein the two films are positioned on top of each other and welded or otherwise sealed along the peripheral edges. The welding or sealing may include, but is not limited to, RF welding or heat sealing. Alternatively, inflatable bladders may be injection molded or blow molded components. Inflatable bladders can be shaped to have a plurality of interconnected inflatable chambers or a single inflatable chamber. A plurality of interconnected inflatable chambers can be formed by conventional molding techniques, including blow molding, injection molding, and thermoforming the films or molded parts and welding or otherwise sealing the films or molded parts together at areas other than the periphery.

The underfoot pump utilized as part of the inflation system is preferably injection molded from a polymeric material including but not limited to thermoplastic polyurethane or ethylene vinyl acetate, although other methods of formation are possible as would be apparent to a person of ordinary skill in the relevant art. The underfoot pump may sit on top of or above the inflatable heel bladder or may be located in other areas of the sole such as the forefoot. The underfoot pump also preferably has an fluid intake hole, preferably with a filter material for preventing moisture from entering the pump, and a fluid fitment receptacle for connecting to a one-way valve.

Figure 11:
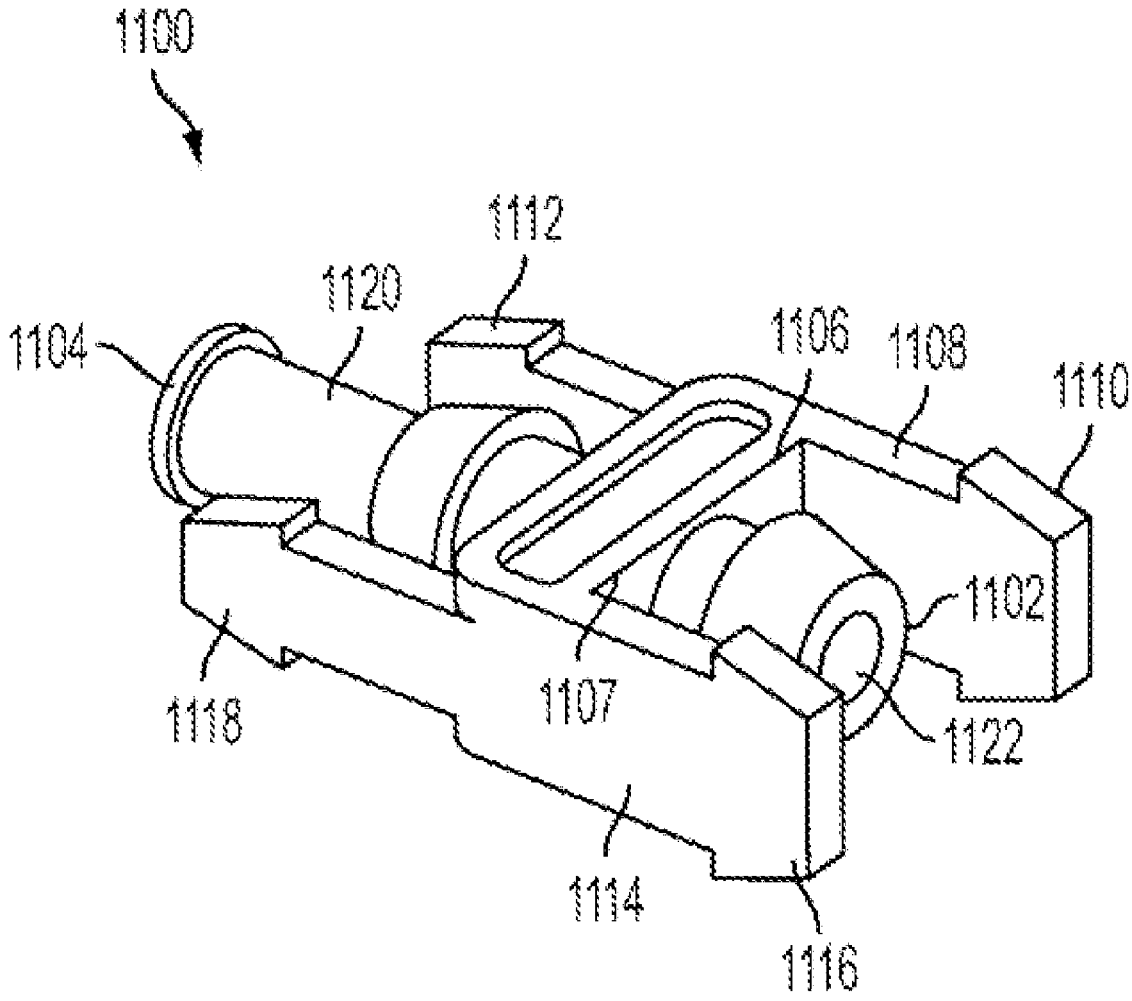
FIG. 11 is a view of an exemplary one-way valve.

An exemplary one-way valve for use in the inflation system of the present invention is shown generally at 1100 in FIG. 11. One-way valve 1100 is preferably a molded piece of a smooth, nonporous material including, but not limited to, polycarbonate that is inserted between the fluid fitment receptacle 1204 of the underfoot pump and manifold 100 or 700. One-way valve 1100 is generally cylindrical in shape and has a first end 1102 and a second end 1104. A first extension 1106 and a second extension 1107 extend perpendicularly from an axis of the body of one-way valve 1100 on opposite sides from each other. A first connector arm 1108 with a first end 1110 and a second end 1112 extend from first extension 1106 substantially parallel to the cylindrical body and a second connector arm 1114 with a first end 1116 and a second end 1118 extend from second extension 1107 substantially parallel to the cylindrical body. There is at least one outlet opening (not shown) along a circumference of the cylindrical body adjacent second end 1104 of one-way valve 1100. An elastomeric sleeve 1120 surrounds the outlet opening. First end 1102 of one-way valve 1100, first end 1110 of first connector arm 1108 and first end 1116 of second connector arm 1114 are inserted into a fluid fitment receptacle 1204 of underfoot pump 1202 such that first and second extension 1106, 1107 abut the fluid fitment receptacle 1204. Second end 1104 of one-way valve 1100, second end 1112 of first connector arm 1108 and second end 1118 of second connector arm 1114 are inserted into openings 114, 116, 116, respectively of manifold 100 or openings 714, 716, 716, respectively of manifold 700 such that manifold 100, 700 abut first and second extensions 1106, 1107. The fluid fitment receptacle of the underfoot pump will have openings similar to openings 114, 116, 116 in manifold 100 or openings 714, 716, 716 in manifold 700 for connecting with one-way valve 1100.

The inflation system of the present invention, may include an fluid pressure regulator. The fluid pressure regulator may be connected to manifold 100, 700 through opening 294, 794 in lateral side surface 208, 708 that intersects with second channel 538, 938. The connection may be through a barb connector, tubing, or other means as would be apparent to one of ordinary skill in the relevant art. The fluid pressure regulator may comprise an adjustable knob for setting a desired pressure at which the inflatable bladder is to be maintained. The adjustable knob may be adjustable according to ordinary means including, but not limited to, rotating or sliding. For example, adjustment may be made over a pressure range of 0 to 20 psi. Additional fluid present in the system bleeds off when the desired pressure is present and the pressure regulator will not allow the bladder(s) to be inflated beyond the desired pressure no matter how much a user attempts to inflate the shoe. The pressure regulator may also contain a provision to allow the inflatable bladder to deflate completely or not inflate at all when the desired pressure is set to 0.0 psi. A flip top may be used to access the pressure regulator as described in U.S. patent application Ser. No. 11/475,254, filed Jun. 27, 2006, which is incorporated herein by reference. The above described pressure regulator is merely exemplary and other pressure regulators could be utilized, such as a release valve, a check valve or a combination check valve and release valve, as described in U.S. Pub. No. 2006/0162186, which is incorporated herein by reference. In an alternative embodiment the fluid pressure regulator may be connected directly to the inflatable heel bladder or inflatable forefoot bladder.

Figure 12:
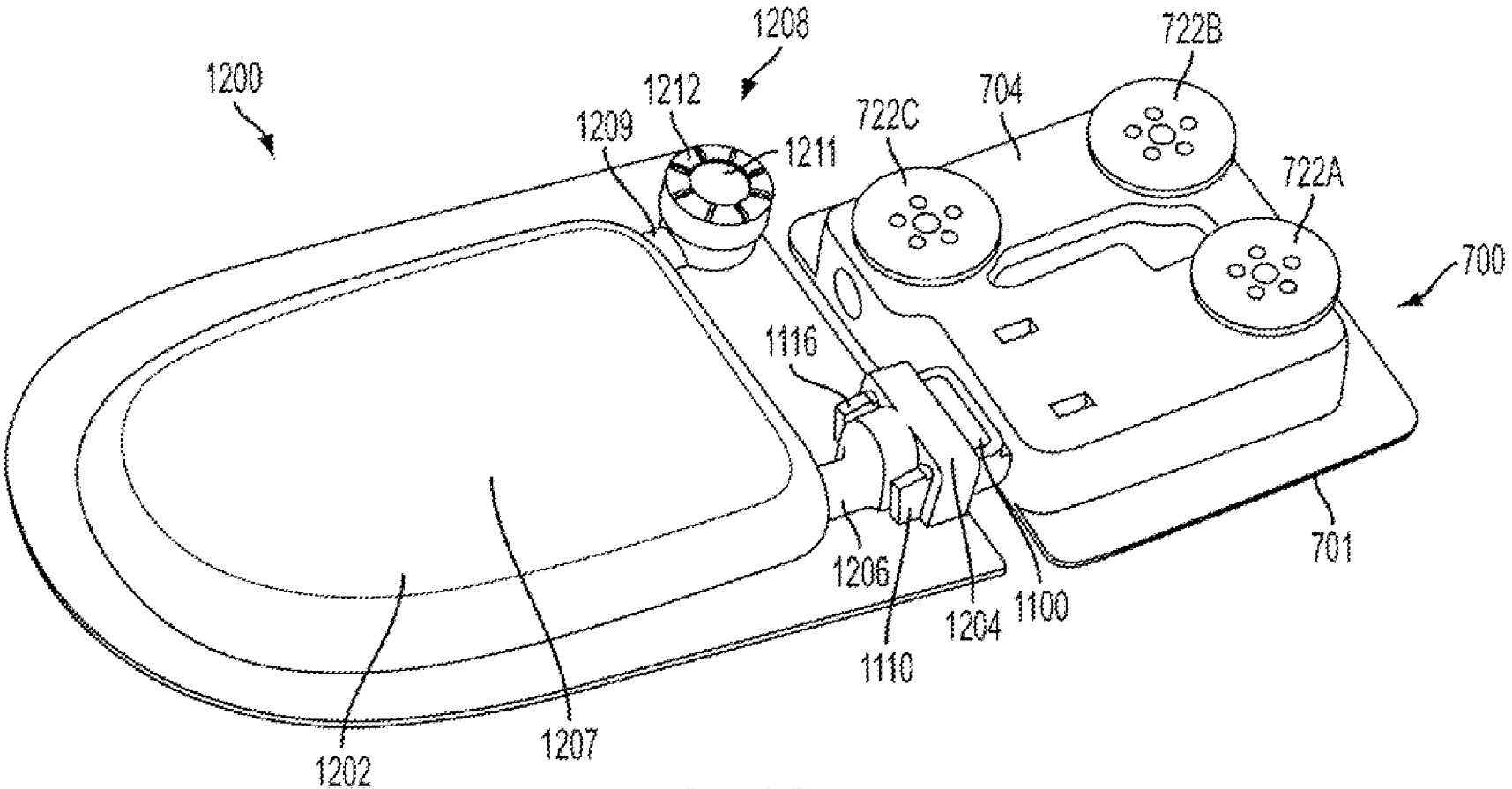
FIG. 12 is a perspective bottom view of an assembled inflation system utilizing the second exemplary manifold.

FIG. 12 depicts an exemplary assembled inflation system having a pump assembly 1200, one-way valve 1100 and fluid transfer manifold 700. Pump assembly 1200 has an underfoot pump 1202 formed with an integral fluid fitment receptacle 1204 with a channel 1206 between underfoot pump 1202 and fluid fitment receptacle 1204. Pump assembly 1200 is preferably injection molded from a polymeric material, including but not limited to, thermoplastic polyurethane or ethylene vinyl acetate, with the underfoot pump 1202 portion being flexible and resilient. Underfoot pump 1202 has a pumping chamber 1207 that is connected to an fluid intake opening 1208 via a channel 1209. Fluid intake opening 1208 preferably has a filter material 1211 attached to a cap 1212 for preventing moisture and dirt from entering the pump assembly. Pumping chamber 1207 preferably has a porous, low density, compressible, and resilient foam insert therein, such as open-cell polyurethane. Fluid fitment receptacle 1204 is a female component that receives portions of one-way valve 1100. Accordingly, fluid fitment receptacle 1204 preferably has fluid outlet opening (not shown) which is connected to channel 1206 and is shaped to receive a first end 1102 of one-way valve 1100 and lock openings on either side of fluid outlet opening for receiving first end 1110 of first connector arm 1108 and first end 1116 of second connector arm 1114 of check valve 1100. Pump assembly 1200 is preferably positioned above the sole of an article of footwear such that when a wearer's foot steps down it presses underfoot pump 1202 such that pumping chamber 1207 collapses forcing fluid through channel 1206 and out fluid outlet opening of fluid fitment receptacle 1204 and into an fluid inlet opening (not shown) in first end 1102 of one-way valve 1100 and through the valve body via opening 1122. The force of the fluid pushes against elastomeric sleeve 1120 covering the outlet opening causing it to expand allowing fluid to escape out the outlet opening past elastomeric sleeve 1120 and into manifold 700. When the pressure is released from underfoot pump 1202, elastomeric sleeve 1120 returns to its original, unexpanded state such that fluid can not flow back into valve 1100.

Second end 1104 of one-way valve 1100 is inserted into opening 714 of manifold 700 and second end 1112 of first connector arm 1108 and second end 1118 of second connector arm 1114 are inserted into openings 716 in manifold 700. When fluid escapes past the elastomeric sleeve 1120 it enters into the first fluid flow channel of manifold 700 and travels through the fluid flow pathway of the first channel 815 to opening 720. The fluid flows through connector 722A and into the attached inflatable forefoot bladder. Fluid flows through the inflatable forefoot bladder to inflate it and then exits through connector 722B attached to the inflatable forefoot, which is inserted into opening 744 of manifold 700. Opening 744 leads to second fluid flow channel 938 of manifold 700 and allows fluid exiting the inflatable forefoot bladder to travel through second fluid flow channel 938 and into the inflatable heel bladder via connector 722C. The inflatable heel bladder is then inflated by the fluid entering therein.

Figure 13:
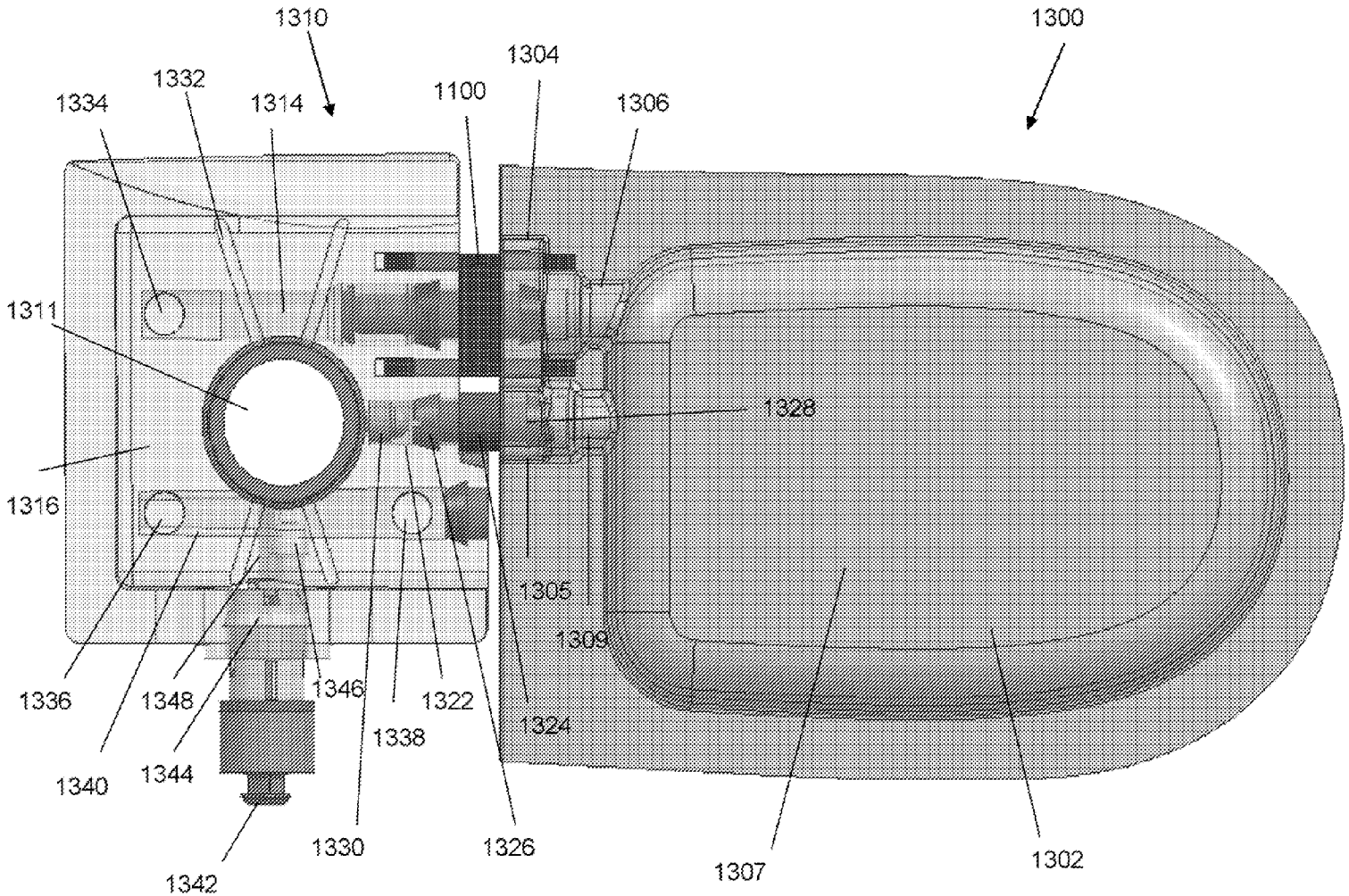
FIG. 13 is a bottom view of an exemplary alternative assembled inflation system.
Figure 14:
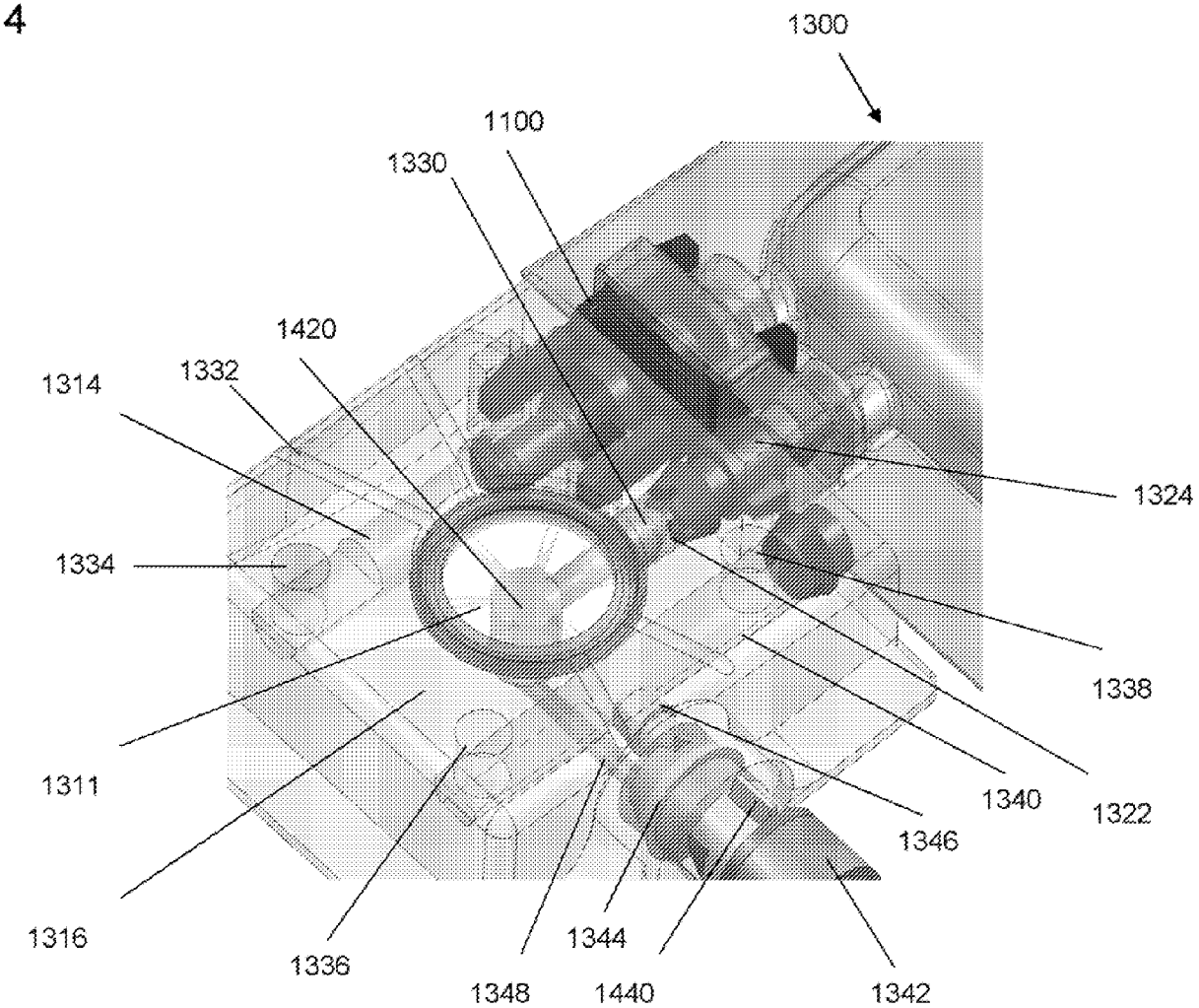
FIG. 14 is an enlarged perspective view of a portion of the exemplary alternative assembled inflation system of FIG. 13.

In an alternative embodiment, as shown in FIGS. 13-14, the fluid intake assembly may be integrated into the manifold rather than the pump assembly. FIGS. 13-14 are shown transparently so that internal components can be seen through outer surfaces. Pump assembly 1300 has an underfoot pump 1302 formed with a first integral fluid fitment receptacle 1304, a second integral fluid fitment receptacle 1305, a first channel 1306 connecting first fluid fitment receptacle 1304 with a pumping chamber 1307, and a second channel 1309 connecting second fluid fitment receptacle 1305 with pumping chamber 1307. Pump assembly 1300 is preferably injection molded from a polymeric material, including but not limited to, thermoplastic polyurethane or ethylene vinyl acetate, with the underfoot pump 1302 portion being flexible and resilient. Pumping chamber 1307 preferably has a porous, low density, compressible, and resilient foam insert therein, such as open-cell polyurethane.

First fluid fitment receptacle 1304 is a female component that receives portions of one-way valve 1100, such as first end 1102, first end 1110 of first connector arm 1108, and first end 1116 of second connector arm 1114. Second end 1104 of one-way valve 1100 is inserted into an opening (not shown) on a heel side surface of manifold 1310 leading to a first fluid flow channel 1314, and second end 1112 of first connector arm 1108 and second end 1118 of second connector arm 1114 are inserted into openings (not shown) in manifold 1310 on either side of the opening leading to first fluid flow channel 1314.

Manifold 1310 has a fluid intake opening (not shown) covered by a filter material 1311 that allows air to enter into the system, but prevents moisture and dirt from entering the system. The fluid intake opening (not shown) is a recess in a bottom surface 1316 of manifold 1310 covered by filter material 1311 and leads to a chamber 1420. Chamber 1420 may be cylindrical in shape. A channel 1322 extends between chamber 1420 and an opening (not shown) in heel side surface of manifold 1310 parallel to first fluid flow channel 1314. A double-ended barb connector 1324 fluidly connects channel 1322 and pumping chamber 1307. A first end 1328 of double-ended barb connector 1324 is inserted into second fluid fitment receptacle 1305 and a second end 1326 of double-ended barb connector 1324 is inserted into channel 1322 of manifold 1310. A one-way check plunger valve 1330, which may be made of silicone, sits in channel 1322 between chamber 1420 and double-ended barb connector 1324.

Bottom surface 1316 of manifold 1310 has a plurality of grooves 1332 formed therein that aid in directing air towards filter material 1311. Air enters through filter material 1311 and flows into chamber 1420. Air in chamber 1420 flows past one-way check plunger valve 1330 when it is unseated by suction from pumping chamber 1307 and into channel 1322. The air then flows through double-ended barb connector 1324 and into pumping chamber 1307. The air flow is then similar to that described above with reference to FIG. 12. The air flows through one-way valve 1100 when pumping chamber 1307 is compressed and into first fluid flow channel 1314. The air travels through inflatable bladders (not shown) connected to opening 1334 in first fluid flow channel 1314 and openings 1336 and 1338 connected to a second fluid flow channel 1340. Ribs may be formed in manifold 1310 to prevent filter material 1311 from tacking to manifold 1310 when subject to suction from pumping chamber 1307.

A fluid pressure regulator 1342 is inserted into an opening (not shown) in the lateral side surface of manifold 1310. Fluid pressure regulator 1342 has a first barb 1344 and a second barb 1346. First barb 1344 holds fluid pressure regulator 1342 in the opening in the lateral side surface of manifold 1310. Second barb 1346 extends past first barb 1344 further into manifold 1310 and is inserted into an opening (not shown) in second fluid flow channel 1340. Air exhausts from second fluid flow channel 1340 into fluid pressure regulator 1342. The exhausted air is directed to a bleed off channel 1348 that runs in a different plane than and perpendicular to second fluid flow channel 1340. Bleed off channel 1348 bleeds the exhausted air into chamber 1420 and can then be recirculated through the system or released to the atmosphere. Fluid pressure regulator 1342 has at least one fin 1440 extending peripherally therefrom that abuts the lateral side surface of manifold 1310. A shank or a portion of an outsole/midsole material (not shown) may cover and protect filter material 1311 and may be attached to the at least one fin 1440 to prevent fluid pressure regulator 1342 from spinning.

While an underfoot pump is shown attached to the heel side of the manifold in the above embodiments it may also be attached elsewhere, such as the forefoot side of the manifold. Also the pumping mechanism may be a manual pump, such as an onboard pump on the upper and connected to the manifold through tubing.

The fluid transfer systems and inflation systems described above are merely exemplary. The advantage of the manifold of the present invention is it can be utilized with a variety of different inflation systems, wherein the individual components of the inflation system can be inserted into the appropriate openings in the manifold. Not every system will utilize all the openings in the manifold and appropriately sized plugs can be placed in unused openings. For example, an inflation system may have just a single inflatable bladder rather than two inflatable bladders. Such an inflation system can still be connected to the manifold of the present invention with the unneeded openings being plugged. The manifold can also be modified to connect to additional components, such as, for example, a third inflatable bladder, as needed in a given inflation system.

As noted elsewhere, these example embodiments have been described for illustrative purposes only, and are not limiting. Other embodiments are possible and are covered by the methods and systems described herein. Such embodiments will be apparent to persons skilled in the relevant art(s) based on the teachings contained herein. Thus, the breadth and scope of the methods and systems described herein should not be limited by any of the above-described exemplary embodiments, but should be defined only in accordance with the following claims and their equivalents.

What is claimed is:

1. A manifold for connecting components of an inflation system in an article of footwear, the manifold comprising:

a top surface;

a bottom surface with a plurality of openings;

a lateral side with at least one opening;

a medial side;

a heel side with a plurality of openings;

a forefoot side;

a first channel connected to two of the plurality of openings in the bottom surface and to one of the at least one opening in the lateral side;

a second channel connected to one of the plurality of openings in the bottom surface and one of the plurality of openings in the heel side; and a first connector inserted into the one of the openings in the bottom surface connected to the second channel.

2. The manifold of claim 1, wherein the first connector comprises:

a flange with a top surface and a bottom surface;

a barbed body extending from the bottom surface of the flange; and a hole extending through the flange and the barbed body.

3. The manifold of claim 1, wherein one of the plurality of openings in the heel side is connected to the first channel and the manifold further comprises:

an opening in the forefoot side connected to said first channel;

a first fluid flow restrictor housing inserted into the opening in the forefoot side; and a second fluid flow restrictor housing inserted into the one opening in the heel side connected to the first channel.

4. The manifold of claim 3, wherein each of the first and second fluid flow restrictor housings comprise:

a top surface, a bottom surface, a front side, a rear side, a left side and a right side;

wherein the top surface has an opening and a locking mechanism adjacent the opening in the top surface along the left side and the right side;

wherein the front side has an opening; and wherein the rear side has a recessed flange with an opening that is smaller than a size of the first channel.

5. The manifold of claim 4, wherein an orifice disk is inserted in the recessed flange of each of the first and second fluid flow restrictor housings and wherein each orifice disk has an opening that is smaller in size than the size of the opening in the recessed flanges.

6. The manifold of claim 4, wherein the rear sides of the first and second fluid flow restrictor housings are inserted further into the manifold than the front sides of the first and second fluid flow restrictor housings.

7. The manifold of claim 6, further comprising:

a first plug inserted into the opening in the front side of the first fluid flow restrictor housing; and a second plug inserted into the opening in the front side of the second fluid flow restrictor housing.

8. The manifold of claim 7, further comprising:

a second connector inserted into one of the two openings in the bottom surface connected to the first channel; and a third connector inserted into the other of the two openings in the bottom surface connected to the first channel.

9. The manifold of claim 8, wherein each of the second and third connectors comprise:

a flange with a top surface and a bottom surface;

a barbed body extending from the bottom surface of the flange; and a hole extending through the flange and the barbed body.

10. The manifold of claim 9, wherein the barbed body of the second connector is locked into the opening in the top surface of the first fluid flow restrictor housing and the barbed body of the third connector is locked into the opening in the top surface of the second fluid flow restrictor housing.

11. The manifold of claim 1, further comprising:

a second connector inserted into one of the two openings in the bottom surface connected to the first channel; and a third connector inserted into the other of the two openings in the bottom surface connected to the first channel.

12. The manifold of claim 11, wherein each of the second and third connectors comprise:

a flange with a top surface and a bottom surface;

a barbed body extending from the bottom surface of the flange; and a hole extending through the flange and the barbed body.

13. The manifold of claim 12, wherein said hole extending through the flange and the barbed body has a first end at a top surface of the flange with a first diameter and a second end at an end of the barbed body with a second diameter.

14. The manifold of claim 13, wherein said first diameter is larger than said second diameter.

15. The manifold of claim 14, wherein a nonwoven material is placed over said second end to form said second diameter.

16. The manifold of claim 14, wherein a film with an opening is placed over said second end to form said second diameter.

17. An inflation system for an article of footwear, the inflation system comprising:

a manifold, wherein the manifold comprises:

a top surface;

a bottom surface with a plurality of openings;

a lateral side with at least one opening;

a medial side;

a heel side with a plurality of openings; and a forefoot side;

an underfoot pump connected to one of the plurality of openings in the heel side of the manifold;

an inflatable forefoot bladder connected to two of the plurality of openings in the bottom surface of the manifold; and an inflatable heel bladder connected to one of the plurality of openings in the bottom surface of the manifold.

18. The inflation system of claim 17, further comprising:

a first channel connected to one of the plurality of openings in the bottom surface and one of the plurality of openings in the heel side.

19. The inflation system of claim 18, further comprising:

a first connector inserted into the one of the openings in the bottom surface of the manifold connected to the first channel.

20. The inflation system of claim 19, wherein the first connector comprises:

a flange with a top surface and a bottom surface;

a barbed body extending from the bottom surface of the flange; and a hole extending through flange and the barbed body.

21. The inflation system of claim 17, further comprising:

a pressure regulator connected to one of the at least one opening on the lateral side.

22. The inflation system of claim 20, further comprising:

a second channel connected to two of the plurality of openings in the bottom surface of the manifold and to one of the at least one opening in the lateral side.

23. The manifold of claim 22, further comprising:

a second connector inserted into one of the two openings in the bottom surface of the manifold connected to the second channel; and a third connector inserted into the other of the two openings in the bottom surface of the manifold connected to the second channel.

24. The manifold of claim 23, wherein each of the second and third connectors comprise:

a flange with a top surface and a bottom surface;

a barbed body extending from the bottom surface of the flange; and a hole extending through the flange and the barbed body.

25. The manifold of claim 24, wherein said hole extending through the flange and the barbed body has a first end at a top surface of the flange with a first diameter and a second end at an end of the barbed body with a second diameter.

26. The manifold of claim 25, wherein said first diameter is larger than said second diameter.

27. The manifold of claim 26, wherein a nonwoven material is placed over said second end to form said second diameter.

28. The manifold of claim 26, wherein a film with an opening is placed over said second end to form said second diameter.

29. The inflation system of claim 25, wherein said inflatable forefoot bladder is attached to said first connector and said second connector and wherein said heel bladder is attached to said third connector.

30. The inflation system of claim 29, further comprising:

an fluid intake check valve associated with the pump; and a pressure regulator connected to the one opening on the lateral side connected to the second channel;

wherein fluid flows through the fluid intake check valve and is pumped through the first channel to the inflatable forefoot bladder, through the inflatable forefoot bladder to the second channel, through the second channel to the inflatable heel bladder and regulated out the system through the use of the pressure regulator.

31. The inflation system of claim 17, wherein said heel pump is stacked on top of said inflatable heel bladder.

32. The manifold of claim 22, wherein one of the plurality of openings in the heel side is connected to the second channel and the manifold further comprises:

an opening in the forefoot side connected to said second channel;

a first fluid flow restrictor housing inserted into the opening in the forefoot side; and a second fluid flow restrictor housing inserted into the one opening in the heel side connected to the second channel.

33. The inflation system of claim 32, wherein each of the first and second fluid flow restrictor housings comprise:

a top surface, a bottom surface, a front side, a rear side, a left side and a right side;

wherein the top surface has an opening and a locking mechanism adjacent the opening in the top surface along the left side and the right side;

wherein the front side has an opening; and wherein the rear side has a recessed flange with an opening that is smaller than a size of the second channel.

34. The inflation system of claim 33, wherein an orifice disk is inserted in the recessed flange of each of the first and second fluid flow restrictor housings and wherein each orifice disk has an opening that is smaller in size than the size of the opening in the recessed flanges.

35. The inflation system of claim 33, wherein the rear sides of the first and second fluid flow restrictor housings are inserted further into the manifold than the front sides of the first and second fluid flow restrictor housings.

36. The inflation system of claim 35, further comprising:

a first plug inserted into the opening in the front side of the first fluid flow restrictor housing; and a second plug inserted into the opening in the front side of the second fluid flow restrictor housing.

37. The inflation system of claim 36, further comprising:

a second connector inserted into one of the two openings in the bottom surface connected to the second channel; and a third connector inserted into the other of the two openings in the bottom surface connected to the second channel.

38. The inflation system of claim 37, wherein each of the second and third connectors comprise:

a flange with a top surface and a bottom surface;

a barbed body extending from the bottom surface of the flange; and a hole extending through the flange and the barbed body.

39. The inflation system of claim 38, wherein the barbed body of the second connector is locked into the opening in the top surface of the first fluid flow restrictor housing and the barbed body of the third connector is locked into the opening in the top surface of the second fluid flow restrictor housing.

40. The inflation system of claim 37, wherein said inflatable forefoot bladder is attached to said first connector and said second connector and wherein said heel bladder is attached to said third connector.

41. The inflation system of claim 40, further comprising:

an fluid intake check valve associated with the pump; and a pressure regulator connected to the one opening on the lateral side connected to the second channel;

wherein fluid flows through the fluid intake check valve and is pumped through the first channel to the inflatable forefoot bladder, through the inflatable forefoot bladder to the second channel, through the second channel to the inflatable heel bladder and regulated out the system through the use of the pressure regulator.

42. An fluid flow system for an article of inflatable footwear, the fluid flow system comprising:

a manifold for connecting components of the fluid flow system;

an intake check valve for introducing fluid into the fluid flow system;

an underfoot pump associated with the intake check valve and connected with the manifold for pushing the fluid introduced in the intake check valve into the manifold and through the fluid flow system;

an inflatable forefoot bladder connected to the manifold in a first location and a second location, wherein the first location receives the fluid from the underfoot pump and inflates the inflatable forefoot bladder and the second location introduces fluid back into the manifold;

an inflatable heel bladder connected to the manifold for receiving fluid from the inflatable forefoot bladder; and a pressure regulator associated with an fluid flow path between the inflatable forefoot bladder and the inflatable heel bladder for regulating pressure in the fluid flow system.

43. The fluid flow system of claim 42, the manifold comprising a first channel and a second channel, wherein fluid flows from the underfoot pump to the inflatable forefoot bladder in the first channel and fluid flows from the inflatable forefoot bladder to the inflatable heel bladder in the second channel.

44. The fluid flow system of claim 42, wherein the underfoot pump is stacked upon the inflatable heel bladder.

* * * * *

UNITED STATES PATENT AND TRADEMARK OFFICE

CERTIFICATE OF CORRECTION

PATENT NO. : 7,934,521 B1
APPLICATION NO. : 11/613982
DATED : May 3, 2011
INVENTOR(S) : Mark Busse et al.

It is certified that error appears in the above-identified patent and that said Letters Patent is hereby corrected as shown below:

In the Assignee section, please delete "Reebok International, Ltd." and insert --Reebok International Ltd.--

Signed and Sealed this
Twenty-sixth Day of July, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,934,521 B1
APPLICATION NO. : 11/613982
DATED : May 3, 2011
INVENTOR(S) : Mark Busse et al.

It is certified that error appears in the above-identified patent and that said Letters Patent is hereby corrected as shown below:

Title Page, Item (73) Assignee, please delete "Reebok International, Ltd." and insert --Reebok International Ltd.--

This certificate supersedes the Certificate of Correction issued July 26, 2011.

Signed and Sealed this
Twenty-third Day of August, 2011

David J. Kappos

David J. Kappos
*Director of the United States Patent and Trademark Office*